US005988349A

United States Patent [19]

Bruner et al.

[11] Patent Number: 5,988,349

[45] Date of Patent: Nov. 23, 1999

[54] APPARATUS AND METHOD FOR SEPARATING AND REJECTING COINS

[75] Inventors: Philemon L. Bruner; David Carlton Bugge, both of Houston, Tex.

[73] Assignee: Imonex Services, Inc., Katy, Tex.

[21] Appl. No.: 07/887,629

[22] Filed: May 22, 1992

Related U.S. Application Data

[63] Continuation-in-part of application No. 07/754,202, Aug. 21, 1991, abandoned, which is a continuation of application No. 07/469,306, Jan. 24, 1990, abandoned, which is a continuation-in-part of application No. 07/163,307, Mar. 16, 1988, Pat. No. 4,911,280, which is a continuation-in-part of application No. 07/042,797, Apr. 27, 1987, abandoned.

[51] Int. Cl.[6] ..... G07D 5/02

[52] U.S. Cl. ..... 194/338; 453/9

[58] Field of Search ..... 453/5, 9, 15; 194/325, 194/334, 338

[56] References Cited

U.S. PATENT DOCUMENTS

| | | |
|---|---|---|
| 688,211 | 12/1901 | Uchermann . |
| 917,629 | 4/1909 | Long . |
| 969,272 | 9/1910 | Grover . |
| 1,087,307 | 2/1914 | Long . |
| 1,503,223 | 7/1924 | Bee . |
| 1,907,064 | 5/1933 | Gottfried . |
| 1,933,752 | 11/1933 | Parks et al. . |
| 2,009,609 | 7/1935 | Edison . |
| 2,014,506 | 9/1935 | Patche . |
| 2,049,170 | 7/1936 | Mills . |
| 2,122,550 | 7/1938 | Adrian . |
| 2,292,628 | 8/1942 | Fry . |
| 2,442,890 | 6/1948 | Garbrielsen et al. . |
| 2,453,437 | 11/1948 | Hokanson . |
| 3,378,126 | 4/1968 | Kuckens et al. . |
| 3,398,303 | 8/1968 | Koch . |
| 3,408,508 | 10/1968 | Kuckens . |
| 3,408,509 | 10/1968 | Niehaus . |
| 3,411,613 | 11/1968 | Andreas . |
| 3,575,273 | 4/1971 | Lajeunesse . |
| 3,768,618 | 10/1973 | Collins . |
| 4,111,215 | 9/1978 | Wicklander . |
| 4,254,857 | 3/1981 | Levasseur et al. . |
| 4,263,924 | 4/1981 | Johnson . |
| 4,396,029 | 8/1983 | Anderson . |
| 4,874,347 | 10/1989 | Kobayashi et al. ..... 453/5 |
| 4,911,280 | 3/1990 | Bruner ..... 194/338 |

FOREIGN PATENT DOCUMENTS

| | | |
|---|---|---|
| 4547/26 | 6/1927 | Australia . |
| 331271 | 9/1903 | France . |
| 469837 | 5/1914 | France . |
| 523069 | 4/1931 | Germany . |
| 3007484 | 9/1981 | Germany . |
| 53142 | 11/1989 | Germany . |
| 19922 | 9/1927 | Netherlands ..... 43/2 |
| 1321241 | 9/1903 | United Kingdom . |
| 464439 | 4/1937 | United Kingdom . |
| 810031 | 11/1957 | United Kingdom . |
| 2105893 | 3/1983 | United Kingdom . |
| 88/08174 | 10/1988 | WIPO . |

*Primary Examiner*—F. J. Bartuska
*Attorney, Agent, or Firm*—Arnold White & Durkee

[57] ABSTRACT

A coin separator/rejector system includes a plurality of coin races which are disposed in a coin separator and rejector body. The races have at least one protrusion along their length so as to deflect downwardly traveling coins and force these coins to alter both their attitude and direction of travel to encounter apertures formed between successive coin races. Coins of a selected diameter travel downwardly along any given coin race for ultimate deposit or credit. Coins of other than the selected diameter are directed into alternative races for rejection or return to the user.

22 Claims, 15 Drawing Sheets

APPARATUS AND METHOD FOR SEPARATING AND REJECTING COINS

CROSS REFERENCE TO RELATED APPLICATIONS

This application is a continuation-in-part of applicant's application Ser. No. 754,202 filed Aug. 21, 1991, now abandoned, which is a continuation of application Ser. No. 469,306 filed Jan. 24, 1990, now abandoned, which is a continuation-in-part of Ser. No. 163,307, filed Mar. 16, 1988, now U.S. Pat. No. 4,911,280, which is a continuation-in-part of application Ser. No. 042,797, filed Apr. 27, 1987, now abandoned.

BACKGROUND OF THE INVENTION

1. Field of the Invention

The present invention relates generally to coin separators and rejectors for use in vending machines, coin operated telephones, video game machines or other applications where mechanical sorting, selection and rejection of coins is required. More particularly, this invention relates to a coin separator and rejector system which utilizes principles of inertia and controlled deflection to selectively discriminate and collect coins deposited in a coin operated machine or appliance. The present invention also relates to a method of separating and rejecting coins employing the described principles.

2. Description of the Prior Art

The simplest type of coin operated machine is one which requires a single coin of a single denomination for operation. In this instance, the basic consideration or problem involving a separator/rejector is to accept the single, desired coin and to reject all others. The problem is solved in one aspect by designing the coin inlet to accept coins no larger in diameter than the desired coin. In a second aspect, the coins which pass through the inlet enter a separator/rejector which accepts the desired coins—i.e., the largest coins—and rejects all smaller coins.

More complex coin operated machines are designed to perform a variety of functions such as accepting more than one coin denomination, accepting combinations of coin denominations, returning change, and returning undesirable coins, tokens, slugs and counterfeit coins. The more complex machines therefore require more sophisticated means for separating coins. Some of these coin separators, for example, sort the coins and direct coins of different desired denominations into separate chutes or cash boxes, or into escrow devices in advance of the cash boxes.

In general, coin operated machines must be rugged as well as reliable. Numerous attempts have been made toward the design of an effective, yet trouble-free, coin separator/rejector to be used in coin operated machines and the like, so that coins which are inserted in the machines may be readily organized and separated. The desired coins are deposited for credit, and undesired coins are rejected and/or ultimately returned to the user.

Many times, the principal design feature of a rejector is to limit the operation of a machine to a particular denomination of coin, as dictated by the price of the merchandise, service, or entertainment available through the machine. Other times, a principal desire is to limit the size of the machine as dictated by space concerns. There is generally very limited space in most machines for a coin rejector. This is a special concern when the rejector must be capable of accepting a variety of coin denominations. In almost all instances, it is desirable to reject pennies and foreign coins.

A variety of rejectors have evolved to address the need to discriminate among various coin denominations. Early coin rejectors used a combination of coin diameter and gravity to reject all coins but those of a preselected denomination. One example of such a rejector is seen in U.S. Pat. No. 917,629. This patent describes a coin rejector with a spiral coin race containing an aperture through a portion of its length. As a coin descends in this device, it is pulled toward the outer diametrical extent of the coin race. If the coin is too small (and thus not of a desired denomination) to be supported at its top and bottom as its passes over the aperture, it is simply hurled out of the coin race. Disadvantages of the device described in U.S. Pat. No. 917,629 include its cumbersome configuration. In addition, the spiral shape of the device requires that it be at least as wide as the diameter of the desired coin. Additionally, the use of a spiral configuration involves an overall vertical length which would be prohibitive in many contemporary applications. Further, it is generally undesirable for the coin to "tumble" from the coin separating mechanism, since the ability of a coin to tumble requires that the rejector employ a width which is oftentimes impractical or even inoperable in conventional vending machines.

Another design using gravity as a means for rejecting undesired coins is seen in U.S. Pat. No. 2,014,506. This device employs an inclined coin race which is fitted with an aperture along a portion of its length. The coin race itself is fitted with an inclined bottom track and a low tolerance upper guide. In this device, coins of less than a minimum diameter travel along the coin race and "tumble" out of the device upon encountering the aperture, since they are no longer supported at both their top and bottom edges. Although this type of device appears sound in principle, it is cumbersome in size, and it has a propensity to fail or "jam", especially when bent or oversized coins are introduced into the coin chute. This device also fails to maintain coins in a preferred on-edge orientation at all times.

To address the need to process coins of different denominations, a number of coin rejectors have been suggested which use a plurality of coin inlet slots disposed along the face of the machine, each slot being connected to a different coin race. Such a device is seen in U.S. Pat. No. 3,768,618. In this device, a number of coin chutes are connected to a corresponding number of coin inlet portals disposed along the machine body. Each coin chute is formed at an angled, downwardly inclined fashion with an aperture or "window" formed along part of its length. When coins of less than a minimum diameter move down these coin chutes, they "topple" through the windows, thereby resulting in rejection. A multiple race setup such as that disclosed in U.S. Pat. No. 3,768,618 also has many of same drawbacks described above. It is inherently bulky because of the number of coin chutes it needs to process multiple coin denominations. Thus, the proper sorting and collection of three different denominations of coins would require at least three separate coin slots, each with its own coin rejector.

Due to a general trend toward miniaturization, as well as the need in the industry to separate multiple denomination coins, more compact coin devices have been designed that employ a plurality of moving parts in order to establish a correct coin credit system with coins introducible from a solitary coin inlet. Such a coin rejector is seen in U.S. Pat. No. 2,292,628. In this and similar designs, a coin inserted in a solitary coin slot on the face of the machine travels downward until it engages a series of coin cradles or "flippers" disposed within the apparatus itself. Depending on the width and diameter of the coin, the coin moves downward and across the face of the rejector via a plurality of coin handling cradles until it reaches a particular coin outlet slot. In this fashion, multiple coin denominations may be used in the machine, with undersized domestic coins (usually pennies) or foreign coins being rejected and returned to the user. Many of the drawbacks associated with this design revolve around the overall complexity of the device itself. In this and similar coin separating devices, up to 80 separate or moving parts may be used, each part subject to varying degrees of wear and contamination from dirt and other corrosives, soon reducing the overall reliability and efficiency of the device and resulting in undesirable incidences of "jamming." Such a multi-component device is also highly sensitive to moisture, and often requires periodic balancing. High incidences of "jamming" resulting from inoperability of the device significantly decreases the profitability of any given vending operation. Servicing "jams" is expensive and often results in user frustration and ultimately nonuse of the machine or appliance itself.

SUMMARY OF THE INVENTION

The present invention addresses problems associated with prior art devices by providing a compact coin system which is capable of receiving and separating multiple coins of various diameters inserted through a coin inlet. The present invention also enables simultaneous or near simultaneous separation of coins, thus enabling even a further decrease in the size requirements of the coin separator/rejector. Further, the present invention enables the early removal of large or oversized coins from the separating mechanism so as to enable a longer separating process for similarly sized coins.

In a broad aspect, the present invention comprises a system in which a coin is introduced at the upper end of a downwardly extending or downwardly inclined coin race. The coin travels downward in the race and in a vertical disposition, i.e., on-edge. The race has vertically disposed walls on each side of the coin which help to guide the coin on its way. The walls are preferably spaced laterally a sufficient distance to tolerate coins which are bent but still capable of passing through the entrance of the race. Moreover, the race walls are dimensioned to retain coins in the race in a substantially on-edge orientation. Most importantly, the race is configured so as to enhance the natural passage of the coin through the system, thereby minimizing undesired deflection while maintaining control over the coin. The use of races and protrusions for positive coin control and separation is described in commonly assigned U.S. Pat. No. 4,911,280, the subject matter of which is incorporated herein by reference.

As set forth in U.S. Pat. No. 4,911,280, positive control is maintained over coins proceeding down the race and during the separation process. Curvilinear protrusions are used to impart a smooth transition to the path of the coin. As the leading edge of the coin engages the protrusion the coin is pivoted on its vertical axis and the leading edge of the coin is aligned with an adjacent aperture. Importantly, as illustrated in U.S. Pat. No. 4,911,280, lateral stability over the trailing edge of the coin is simultaneously maintained to prevent the path of the coin from differing from its alignment with the aperture. In other words, skidding or slipping of the coin as it pivots on its axis is kept to a minimum such that the alignment of the coin is consistent with its path of travel.

More specifically, a positive, lateral force is applied to the coin which causes the coin to be deflected to a course which is angled laterally relative to its original course. Concomitantly or sequentially, a second positive, laterally disposed force may be applied to the coin which causes the coin to tilt along with the change in direction. Thus, the coin preferably changes direction and also tilts toward the new direction, while remaining in a generally vertical or "on-edge" disposition.

As the downward-traveling coin is directed from one wall of the race to the opposite wall, an aperture is positioned in the opposite wall for the purpose of receiving any coin smaller in diameter than a desired coin. Along the top of the aperture is a downward extending flange or section of wall which depends sufficiently to engage the upper edge of the desired coin but not any smaller coin. Preferably, a similar flange or section of wall projects upwardly along the lower boundary of the aperture sufficiently to engage the lower edge of the desired coin to maintain the lateral stability of the coin and thus maintain alignment with the aperture. Preferably, the bottom flange does not extend along the entire length of the aperture.

As each coin is thrust and inclined toward the aperture, each desired coin finds itself spanning the aperture and continuing along the coin race past the aperture. Each smaller coin, however, travels into the aperture for further disposition. Each desired coin and each smaller coin preferably remain in a generally vertical disposition. Gravity acts on both types of coins, during their separation, but it is the lateral force or forces which primarily effect the separation. These lateral forces are created by the overall design of the coin race.

If additional coin separation is desired, in the second race a lateral force, or combination of forces, again thrusts each coin toward the second aperture where any coin smaller than a second desired size is passed through the second aperture for further disposition. Meanwhile, each coin desired at this second stage continues its travel along the second race past the second aperture. In alternative embodiments of the present invention, the primary coin race, protrusion and associated aperture setup may be designed to accept only smaller coins, diverting instead larger coins to a second aperture for further disposition.

As discussed, coins of greater than a selected diameter, are physically held in the primary coin race. Preferably, the coin is held in the primary race by the cumulative effect of a retaining flange, and is then carried downward in the primary coin race for ultimate collection or credit. If the coin or token is less than the selected diameter, the coin is not held in the primary coin race but is instead deflected through the aperture formed between the primary and secondary (or alternate) races where it preferably engages a deflecting shoulder. This deflecting shoulder is formed in the upper extent of the secondary coin race and serves to realign the coin for proper travel down the secondary race. Utilizing a series of races and protrusions in this fashion, coins may be selectively routed through a coin race network for ultimate recovery and/or credit at the bottom of the rejector body.

In an alternative embodiment, as the coin travels down the race, it encounters a flange or a portion of the wall itself which extends laterally into the coin race at a selected height above the track of the race sufficient to engage coins of a selected minimum diameter. In most cases, this protrusion or flange is adapted to remove the largest coin operable in the device, e.g., a quarter. This wall portion or flange is generally configured to alter the course of the coin sufficiently to move the coin through an aperture deposed in the wall of the coin race wherein the coin may be rechanneled to a second coin race for credit or return to the customer. It is preferred that the coin maintain a generally vertical or on edge disposition at all times as it travels through the rejector.

This embodiment allows a variety of coins to be separated into adjoining parallel races in a simultaneous or near simultaneous fashion. Near simultaneous separation may be accomplished by the placement of the directing flanges or protrusions on opposite walls of the coin race in a offset fashion and at a height sufficient to remove coins of a selected but decreasing diameter, while allowing coins of a lesser diameter to travel through the primary coin race unimpeded.

Corresponding apertures are preferably situated in the wall of the coin race so as to allow for the removal of coins into other races. Simultaneous rejection may be accomplished utilizing the aforementioned flanges in conjunction with rejecting/separating mechanisms disclosed in U.S. Pat. No. 4,911,280.

In such a fashion, coins or tokens of a larger diameter are moved into other races while smaller coins, e.g., nickels and dimes, remain in the primary race for further processing. The ability to maintain such coins in the primary coin race is beneficial to allow fine size differentiations between coins. Initial rejection of larger coins is desirable from the standpoint of allowing a greater number of coins to be stored in the coin changer. Initial rejection of larger coins is also desirable so as to allow the overall size of the rejector to be decreased.

Magnets strategically placed along the individual coin races can be used so as to induce the removal of ferrous slugs, tokens, or undesirable coins from the coin race. Such magnets may be used individually or in conjunction with other separating and rejecting systems, and their strength may be modified dependent on a given application.

In a preferred embodiment of the present invention, a series of coin races are formed together in a rejector body, the uppermost coin race being connectedly disposed below a solitary coin inlet. The coin races themselves are closely situated in side-by-side planes in a substantially parallel planar fashion with each other, and are connected by a series of apertures formed therebetween in the receiver body. One or more directing flanges are situated along the side walls of each coin race opposite each aperture, the number of directing flanges and apertures being commensurate with the application for which the rejector is used. Beyond the aperture from the directing flanges is the next coin race which is designed to receive coins directed through the aperture, and guide the coins downwardly in the receiver body for further processing and collection. In this fashion, multiple denominations of coins may be accurately processed in a very compact manner.

As noted, the present apparatus is characterized by a plurality of coin races situated in approximate parallel planar fashion to each other, these races being collectively disposed in a rejector body. As a coin is inserted in the coin inlet, it travels downward along the uppermost or primary coin race until it engages a directing flange which preferably causes the coin to alter its direction of travel. In negotiating the directing flange, the coin is forced to describe a generally arcuate path leading along the directing flange. In other embodiments, the directing flange may be supplemented with the placement of a magnet along the coin race.

The above system is applicable to coins of several denominations, simply by the addition of a sufficient number of apertures and races. In all such applications, it is important that the overall sequence of races and apertures be configured to keep the coins in a vertical disposition and in substantially continuous motion.

Depending on the nature of the machine or device with which the coin rejector of the invention is employed, coins separated and moved through an aperture as described above may be processed in several ways. If the machine is designed to accept and operate on coins of a single denomination, all coins greater than a selected diameter are simply routed to a return race or chute which returns them to the customer. Alternatively, if the machine is designed to accept coins of more than one denomination, each coin separated and moved through an aperture is directed into a second, downward race which then routes the coins for credit.

Where it is desired to accept coins of a single denomination, and the size of the rejector body is a consideration, such as in coin operated video games, it would be desirable to separate oversized and undersized coins through the same aperture. In this embodiment, each coin proceeding down the race encounters a curvilinear protrusion, such as previously set forth, which aligns the leading edge of the coin with the aperture. In the case of oversized coins, a flange extends from the upper portion of the protrusion and provides an extended surface area which engages the leading edge of oversized coins and aligns the leading edge of the coin with a portion of the aperture dimensioned to pass oversized coins. Coins of the desired diameter are aligned with the aperture, but encounter a retaining flange which retains the desired coin in the race for acceptance. Undersized coins are aligned with the aperture and pass beneath the retaining flange and through the aperture.

The overall shape of the coin separator/rejector of the present invention may vary as desired. It is specifically contemplated that a block-like structure be used to replace the box-like collectors that are used in many present-day vending machines, coin operated soft-drink machines, laundry machines, and the like. It is further contemplated that at least one embodiment of the present invention be used to replace specific parts of existing rejectors, thereby incorporating the preexisting framework of the rejectors while substantially eliminating all moving parts. Replacement of rejector components which employ coin cradles or flippers is of particular interest. It is specifically contemplated that the rejectors of the present invention be molded or otherwise fabricated from synthetic resins in preference to metals.

Although the system of the invention operates remarkably free from jamming by bent coins and the like, specific means may be provided to dislodge mangled coins and other like items which may find their way into the device from time to time. Dislodging levers and similar devices already in use may be adapted for this purpose. It is common practice in the case of rejectors employing coin cradles to build a rejector in segments which are hinged together with a coin path housed between two segments. By depressing a suitable lever, the hinged segments are forced apart, and a trapped coin simply drops out. As suggested above, in a preferred embodiment of the device, the rejector body of the invention may be formed in multiple distinct sections so as to be directly adaptable to a conventional coin freeing mechanism. Using this setup, activation of the freeing mechanism would cause the distinct sections or plates of the receiver body to move apart about a hinged area at one edge of the receiver body, such that any coins trapped or lodged within the receiver body may fall free for ultimate recovery by the user.

The present invention provides many advantages over the prior art. First, the overall simplicity of the present device markedly reduces problems associated with mechanical failure due to wear, corrosion, and dirt buildup caused by environmental exposure as well as constant use. In most embodiments, the present system has no moving parts and is therefore substantially unaffected by moisture or other corrosive agents that may be present in the area where the device is used. Additionally, the present system has no electrical components which might be particularly affected by such corrosive agents. This is important if a rejector is to be used in such applications as car washes, laundromats, or other areas where steam or moisture are present.

Second, the design of the present invention allows for continuous uninterrupted operation, greatly reducing the need for periodic maintenance or delicate balancing of the machine in which it is used. This is important since vending machines, video game machines and the like are often exposed to bumping or jostling during operation. It has been found that such movements can soon render conventional rejector setups at least partially inoperable.

Third, the present invention allows for effective handling of coins which are bent or damaged. This function is accomplished by the internal coin race configuration which encourages coins to undergo a sliding motion as they move through the system if they are unable to roll about on their axes. This function is also accomplished by the tolerances of the coin races themselves, which in most embodiments do not usually discriminate as to the width of the coin. Thus, bent coins may be accepted and readily processed.

Additional advantages associated with the present invention include its ability to maintain control over the coin during all aspects of its travel through the system, thus eliminating random deflections such as may be caused by free falling coins. This is important since controlled coin handling allows the present system to accurately process a plurality of different diameter coins, organizing each for credit, and returning any undesired coins or tokens to the user. This feature also substantially reduces the noise commonly associated with coin rejectors. Most importantly, this feature substantially contributes to the overall efficiency of the system itself by providing for a constant, regulated flow of coins.

As earlier described, the coins processed by coin operated machines are generally passed through coin chutes to deposit boxes, or to accumulators or escrow devices and ultimately to deposit boxes. The system of the present invention facilitates the delivery of coins to the coin chutes in a vertical disposition. Movement of the coins is thereby under substantially continuous control; tumbling and erratic movements of the coins are greatly reduced.

Some conventional rejectors use coin races which are vertically disposed but tilted from the vertical such that coins travelling along the races may fall by gravity through apertures arranged along the races toward which the coins are inclined. It is contemplated that races of this nature may be used with the present invention, but their use is not preferred since travel of a coin while leaning against a wall may tend to slow down the coin.

The present system offers a further advantage over the prior art by providing a low cost compact coin separator/rejector which is able to efficiently process a variety of different diameter coins.

BRIEF DESCRIPTION OF THE DRAWINGS

The invention may be better understood by reference to the drawings listed below.

DETAILED DESCRIPTION OF THE PREFERRED EMBODIMENTS

Figure 1:
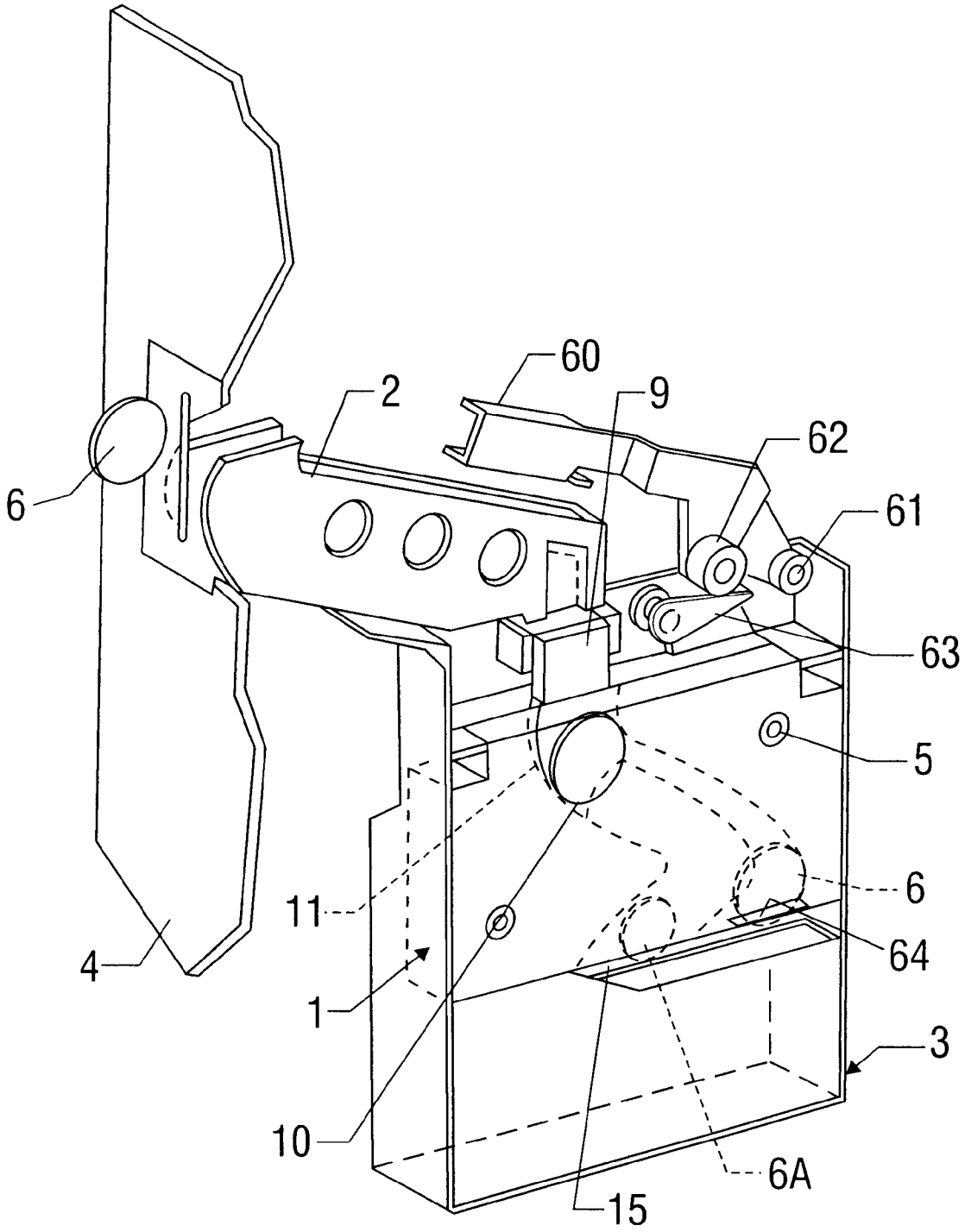
FIG. 1 is a perspective view of one embodiment of the device of the invention as it may be fitted in an existing common type of coin rejection unit.

FIG. 1 illustrates a general embodiment of the invention as it would be mounted in a conventional coin-operated machine such as a cigarette machine. A typical cigarette machine operates solely on quarters and rejects all other coins such as dimes, nickels and pennies. A well known rejector used in such machines is manufactured by National Rejectors, Inc. A form of that particular rejector employs coin cradles to accept quarters.

The apparatus shown in FIG. 1 includes a cutaway panel 4 of a vending machine, a coin neck slot 2, and a coin inlet 9 at the lower end of the slot 2. The coin rejector housing 3 is located behind the panel 4 and is adapted to receive the rejector 1 such that the coin inlet 9 is directly above the upper end of the coin race 10 in the rejector.

Figure 2:
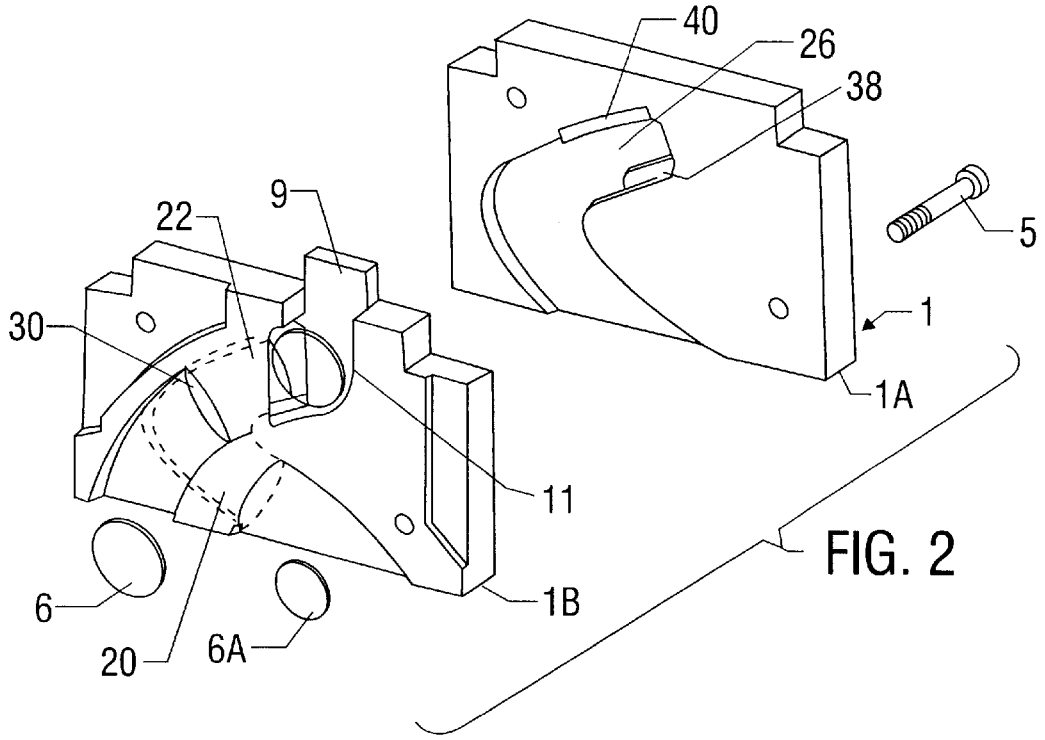
FIG. 2 is an exploded perspective view of the embodiment of FIG. 1 taken from the back side of FIG. 1.

As shown in FIG. 2, the rejector 1 may be an assembly of two sections or slabs 1A and 1B held together by several screws or bolts 5. Alternatively, these sections may be held together via a hinge and spring set up (not shown).

Referring to FIGS. 1 and 2, the apparatus typically includes a lever 60 pivotally mounted on the housing 3 by a pivot 61. A roller 62 mounted on the lever 60 is positioned to contact and depress the wedge 63 which is also pivotally mounted on the housing 3. Depression of the lever 60 causes the wedge 63 to force its way between the sections or slabs 1A and 1B and to separate them sufficiently to enable coins stuck in the race to drop out of the rejector. As in conventional rejectors, sections 1A and 1B may be resiliently held or hinged together rather than rigidly bolted together.

As seen in both FIG. 1 and FIG. 2, when the sections 1A and 1B are joined or held together, they define a first or primary coin race 10 which is inclined downward from the coin inlet 9 to a coin exit portal 64. A coin receiving shoulder 11 preferably forms the uppermost portion of the race 10, and is curved to impart a smooth continuous transition for a coin entering the race 10 from the inlet 9.

A protuberance or protrusion 22 is spaced down the race 10 from the inlet 9. As illustrated, this protrusion is curvilinear and serves to deflect a coin traveling in the race 10 toward an aperture 30. Aperture 30 runs along the primary race 10 and communicates between the race 10 and second or secondary coin race 20. The secondary race 20 runs parallel to the primary race 10 for a short distance and then curves and runs substantially counter to race 10 in its lower portion to its separate coin exit 15. Coins successfully traversing the protrusion and aperture setup are directed to portal 64.

Aperture 30 is formed between races 10 and 20 and is bounded above and below by lower and upper flanges or ledges 38 and 40, respectively. These flanges extend laterally into the aperture 30 distances sufficient to engage the upper and lower edges of a selected coin 6, such as a quarter, but insufficient to engage the similar edges of other smaller coins, such as nickels, dimes and pennies.

Figure 3A:
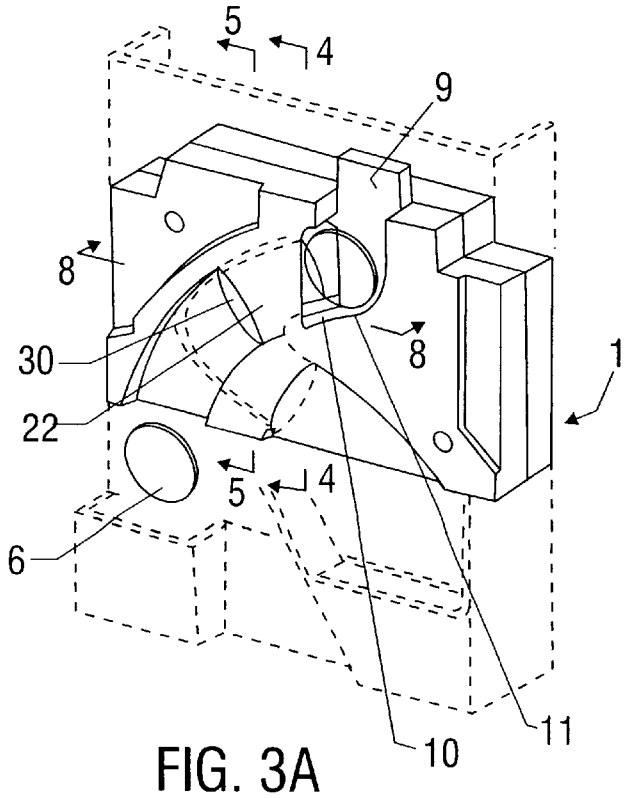
FIG. 3A is a perspective, partially phantom view of the embodiment of FIG. 2, showing the interrelation of the primary and secondary races.
Figure 3B:
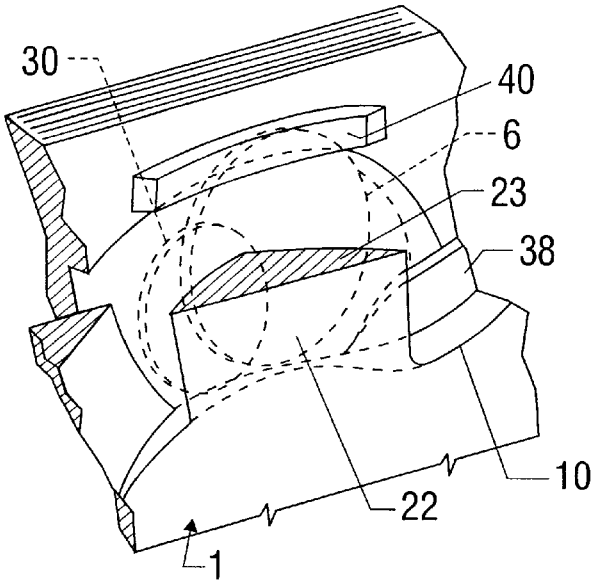
FIG. 3B is a cutaway perspective view of one embodiment of FIG. 3A, and illustrates the general shape and positioning of a deflecting protrusion in relation to an aperture.
Figure 4:
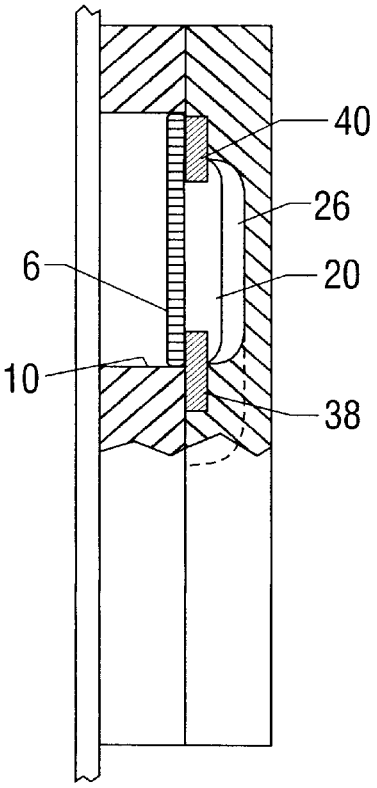
FIG. 4 is a cross-sectional illustration taken along the plane 4—4 in FIG. 3A, and illustrates the attitude of a coin of a preferred diameter as it travels downward along the coin race.
Figure 5:
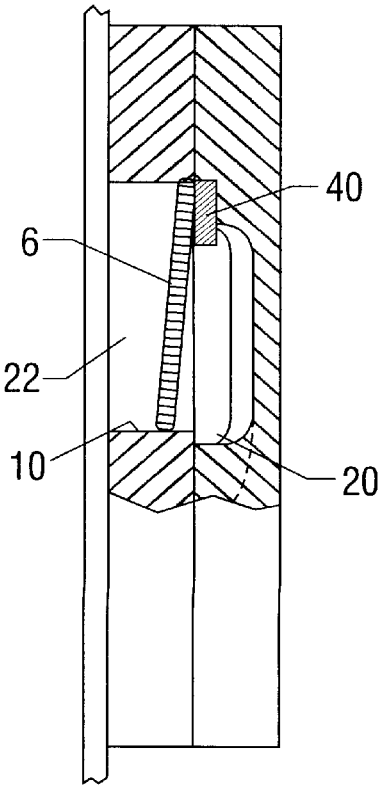
FIG. 5 is a cross-sectional illustration taken along the plane 5—5 in FIG. 3A, and illustrates the attitude of a coin of a preferred diameter as it encounters the protrusion.
Figure 6:
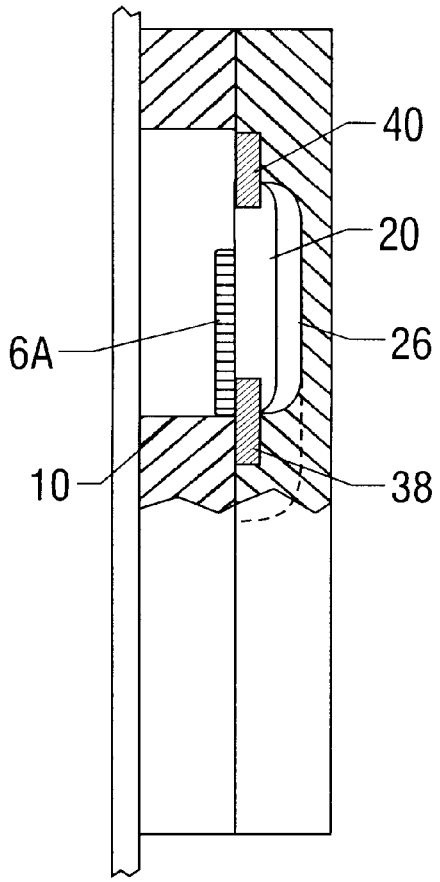
FIG. 6 is the same view as FIG. 4, and illustrates the attitude of a coin less than a preferred diameter as it travels downward along the coin race prior to encountering a protrusion.
Figure 7:
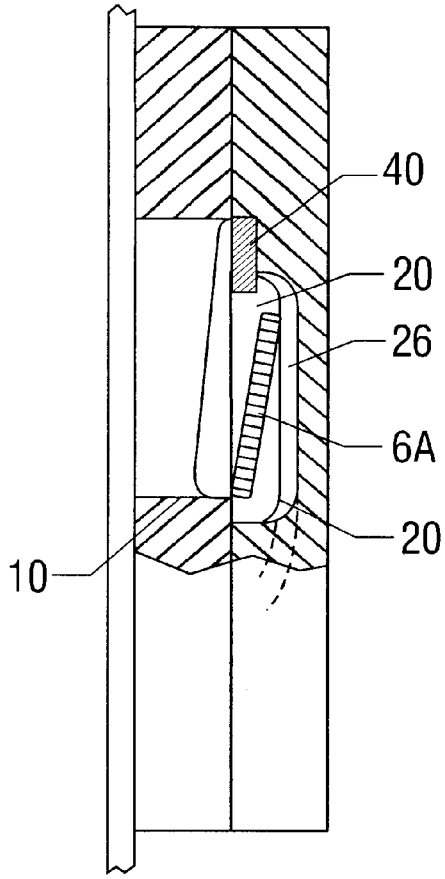
FIG. 7 is same cross-sectional view as in FIG. 3A, and illustrates the attitude of a coin less than a preferred diameter as it encounters the protrusion and is deflected into a secondary coin race.
Figure 8:
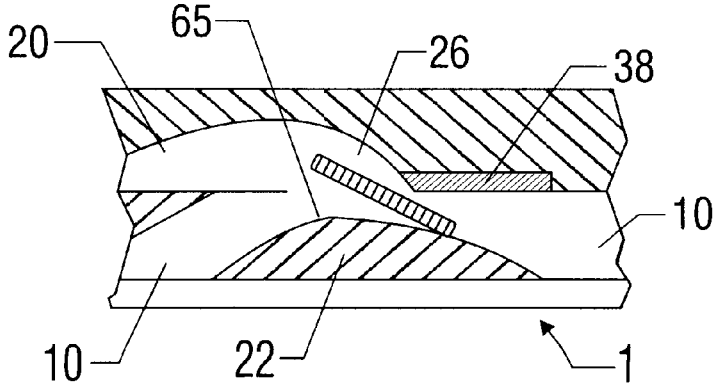
FIG. 8 is a cross-sectional view taken along the section lines 8—8 in FIG. 3A.

As illustrated in FIG. 3B, the upper flange 40 is preferably arcuate in shape. This arcuate shape is desired since flange 40, in cooperation with the protrusion 22, defines the configuration of the coin race 10 in which the selected coin 6 travels as it is laterally displaced by the protrusion 22. As thus designed, the combination of these two elements, 22 and 40, provide a smooth transition for the coin 6 descending through the rejector 1. In such a fashion, complete control is exerted over the coin at all times during the selection and rejection process. The leading edge of the coin is aligned with the aperture, and the configuration of the race otherwise maintains the lateral stability of the trailing edge of the coin as it either proceeds through the aperture or works its way around the protrusion with the aid of retaining flange 40.

The protrusion 22 tapers as it extends down the race 10, until it reaches the apex or contact edge 65. This apex or contact edge 65 is substantially opposite the aperture 30. In preferred embodiments, this contact edge 65 is inclined upstream as will be further described herein.

Referring to FIGS. 1–8, in operation, coins inserted in the opening to the neck 2 travel down the neck, where they enter the rejector body via the coin inlet 9. As they drop through the inlet 9, they strike the shoulder 11 which guides them down the primary coin race 10, the walls of which are dimensioned to retain coins in a substantially on-edge orientation. As they travel along the race 10, the coins are vertically disposed in a substantially on-edge orientation and tend to roll or slide along the race. As the coins encounter the protrusion 22, they are pushed or deflected by the protrusion 22 such that the leading edge of each coin as it engages the protrusion is pivoted on its vertical axis. Thus, each coin experiences a lateral change of direction in the general direction of the aperture 30. Preferably, the protrusion 22 also causes each coin to lean or incline toward the aperture.

Depending on the size of each coin, the coin will experience one of two events as it approaches the aperture 30. If the coin is of a desired size, i.e. a quarter, the upper and lower edges of this coin 6 will encounter the upper and lower flanges, 38 and 40 respectively, be turned on its vertical axis, and then continue down the coin race 10 in a vertical disposition until it exits through the coin portal 64. In effect, the coin 6 remains in the coin race 10 by traversing or working its way around the protrusion 22.

If a coin smaller than a specified size, such as coin 6A, is traveling down the race 10, the bottom edge of this coin will initially engage the lower flange 38 but not the upper flange 40. Then, as the coin 6A continues along the race 10, the lateral thrust imparted by the protrusion 22 causes the upper edge of the coin to pass under the upper flange 40 and through the aperture 30 into the secondary coin race 20. At the same time, the lower edge of the coin 6A preferably runs beyond the end of the lower shoulder or flange 38 and through the aperture 30 into the secondary race 20. As illustrated, as the coin proceeds towards and through the aperture, the lateral movement of the trailing edge of the coin is controlled to maintain the alignment of the leading edge of the coin with the aperture.

The lower flange 38 is preferably drawn only partially across the aperture 30 in order to properly align the smaller coin 6A in a plane substantially parallel to the secondary coin race 20. In such a fashion, the coin 6A maintains an on-edge orientation as it negotiates the transition from the primary coin race 10 to the secondary coin race 20. Maintenance of such an on-edge orientation greatly reduces the width necessary in the rejector body 1 while greatly enhancing overall operational efficiency.

As the coin 6A travels into the race 20, it encounters the deflecting shoulder 26. As explained earlier, this shoulder is designed to impart a smooth change of direction in the coin 6A and to assure its vertical disposition as it now travels down the secondary race 20. This deflecting shoulder 26 preferably is tapered in a fashion substantially parallel to the upstream face of the protrusion 22. As shown in FIG. 2, the coin 6A ultimately exits the rejector body 1 through the exit portal 15.

A preferred embodiment of the present invention is seen by reference to FIGS. 9–13. As noted in the discussion of the general embodiment, the rejector body 100 is generally characterized by a two-piece assembly, 100A–100B, which is joined about a pivot or hinge 110. To maintain a close contacting relationship between the two pieces, a spring or similar tension means 111 may be utilized. In such a fashion, the two pieces may be mechanically separated to enable coins stuck in the rejector body to drop out of the rejector.

Figure 9:
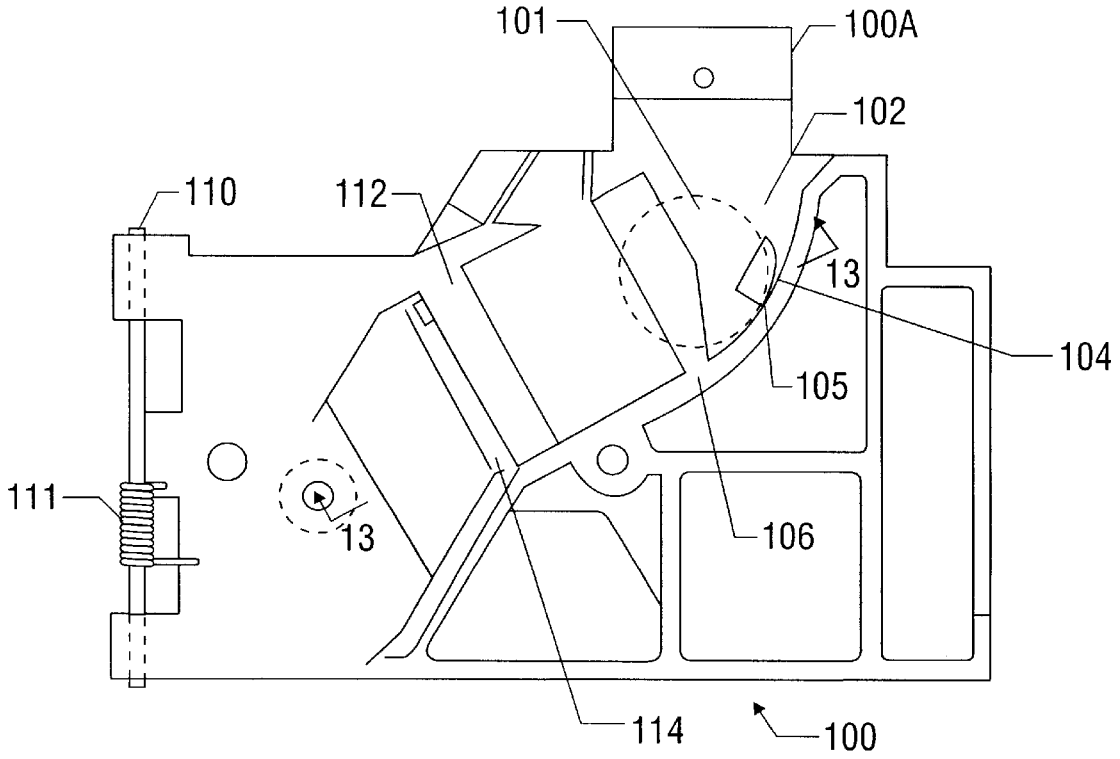
FIG. 9 is a side view of one preferred embodiment of the invention.
Figure 10:
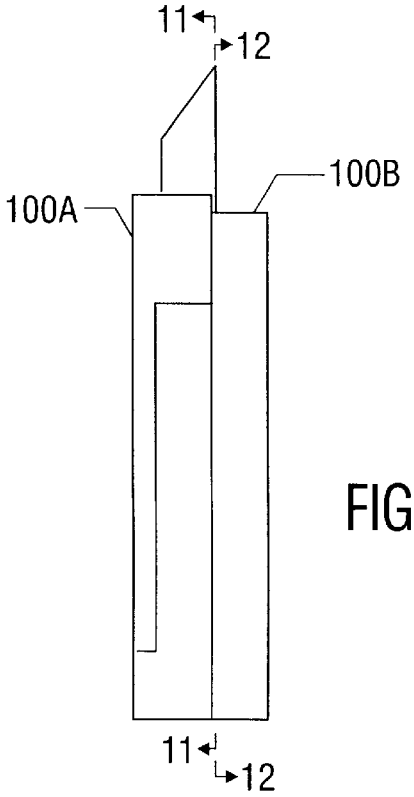
FIG. 10 is an end view of the preferred embodiment illustrated in FIG. 9.
Figure 11:
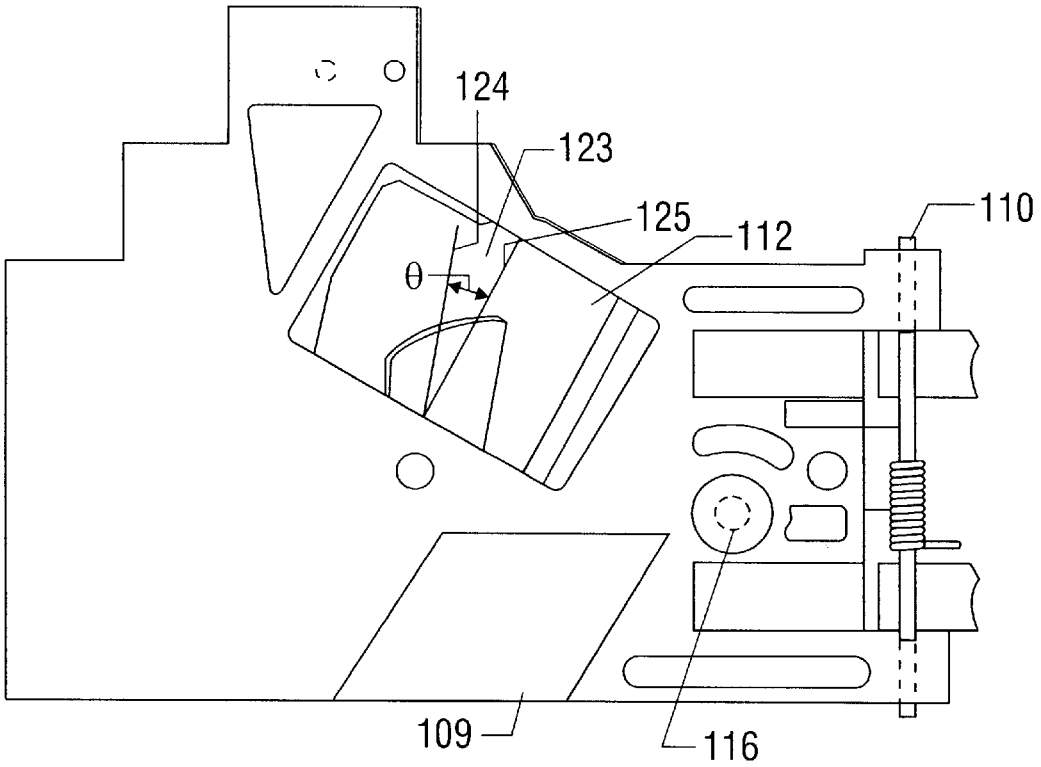
FIG. 11 is a side view of the preferred embodiment as illustrated in FIG. 9 taken along section lines 11—11 in FIG. 10.

In this embodiment, a primary coin race 106 is disposed in the body 100, and defines a coin deflecting shoulder 104 at its upper extent terminating in a coin outlet 109. Along the coin race is positioned a protrusion 112 situated approximately opposite, but slightly offset of an aperture 114. Referring to FIGS. 9 and 11, the protrusion 112 defines a deflecting surface 123 at its upstream face. Descending coins 101 contact the surface about a line or edge of contact 124. As may be seen by reference to FIG. 11, this contact edge or launching surface 124 is angularly oriented with respect to a line 125 drawn normal to the primary coin race 106. More specifically, the bottom of this line of contact 124 is displaced downstream such that the launching surface 124 as a whole is inclined upstream at an angle θ. It has been found that the angle 6 between the line measured to the primary race 125 and the line of contact 124 should be such as to establish the line of contact 124 approximately normal to the support surface on which the vending machine is situated in order to consistently and controllably channel various diameter coins 101 through the aperture 114. Orientation of the protrusion 112 in this manner prevents coins 101 entering coin race 106 from experiencing premature deflection upon engagement with the surfaces within the race 106, thus resulting in undesired wear within the rejector 100 and enhancing the risk of jamming. Further, the described orientation of the protrusion 112 also aids in the processing of bent or damaged coins which would ordinarily cause a failure or jam.

Figure 12:
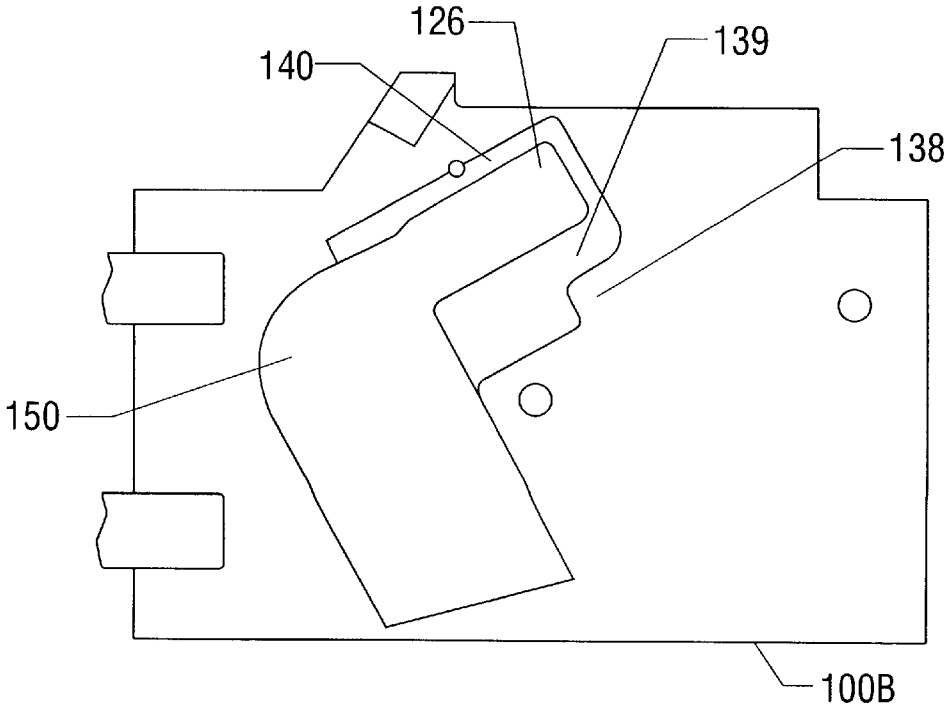
FIG. 12 is a side view of the preferred embodiment illustrated in FIG. 9 taken along section lines 12—12 in FIG. 10.
Figure 13:
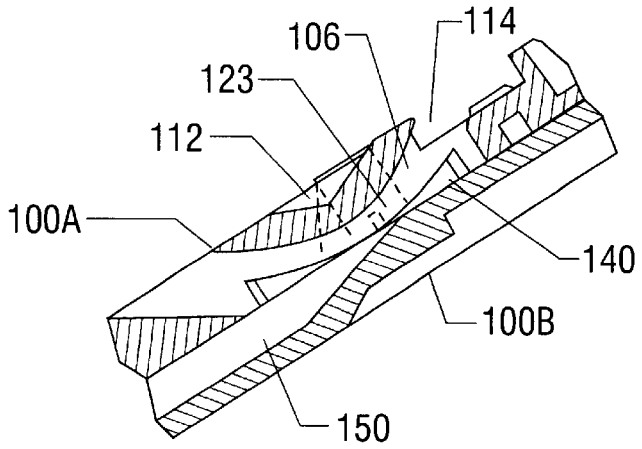
FIG. 13 is a cross section view of the preferred embodiment shown in FIG. 9 taken along lines 13—13 in FIG. 9.

Referring to FIGS. 11–13, coins 101 encountering the contact edge 124 of the deflecting surface 123 are deflected against lower and upper retaining flanges 138 and 140, respectively. As described in association with the general embodiment (FIGS. 1–9), the upper retaining flange 140 is arcuate in shape so as to define a curved primary coin race 106 for the coin 101 as it navigates the protrusion 112. This may be best seen in the cutaway top view of FIG. 13. In this fashion, greater control may be maintained on the coins 101 in all attitudes of their travel along the primary race 106. Further, such a configuration significantly reduces the amount of unnecessary and nondesired deflection by reducing the "tolerance" available to a coin as it is forced to pivot on its axis, hence allowing more consistent selection and rejection processing. In other words, skidding and slipping of the coin as it pivots on its axis is kept to a minimum such that the alignment of the coin is consistent with its path of travel. By reducing the tolerance available to the coin as it pivots, coins will pass through the aperture consistently. Such reliability is essential to industry acceptance of a rejector.

In this preferred embodiment, the lower retaining flange 138 extends part way across the aperture 114 culminating in a beveled surface 139. This surface 139 preferably forms both the top and sides of the lower flange 138 and provides a smooth transition between the primary race 106 and the deflecting shoulder 126 formed at the upper end of the secondary coin race 150. Utilization of such a beveled surface 139 results in a controlled, upright movement of coins rejected through the aperture 114.

Referring again to FIG. 9, a secondary protrusion 105 may be formed at the base of the deflecting shoulder 104 upstream from the primary protrusion 112. Preferably, this protrusion 105 extends part way along the base of the primary race 106. In operation, the protrusion 105 causes the bottommost portions of coins 101 to be laterally displaced, and thus more preferably oriented, upon encountering the combination of protrusion 112 and aperture 114. In this way the coin is pre-aligned in the primary race upstream of the aperture and protrusion such that the coin encounters the protrusion and aperture at an optimum angle.

As described earlier, it is a particular feature of the invention that it is directly applicable to many conventional coin operated machines. This is especially true of vending machines and other machines which employ coin cradles. In these machines, the rejector of the present invention can be simply substituted for the conventional cradle type rejector. Such substitution has been observed to reduce markedly the operating problems associated with the conventional rejector.

In this regard, it has been found generally more economical to accept an occasional slug than to risk jamming the rejector by trying to reject the slug. Further, the cost of a single service call far outweighs the cost of absorbing the loss caused by a slug. Should slugs become a problem, however, the rejector of the invention may be readily modified using conventional magnets and the like for dealing with the problem. An example of such an adaptation is seen in FIG. 11 where a small magnet 116 is situated adjacent the primary coin race 106. In preferred embodiments, this magnet 116 may assume an "on" or "off" position, depending on whether the magnet is depressed into the body piece 100A or situated so as to be in contacting relation with coins as they pass through the aperture 114.

An alternative embodiment of the present device is seen in FIGS. 14–17. These figures illustrate a multiple coin rejector adapted to process four different coin types, e.g., a quarter 230, dime 233, nickel 232 and penny 231, for ultimate collection or rejection. Similar to the rejector previously described, this embodiment utilizes principles of controlled deflection and collection to process even bent or mangled coins.

Figure 14:
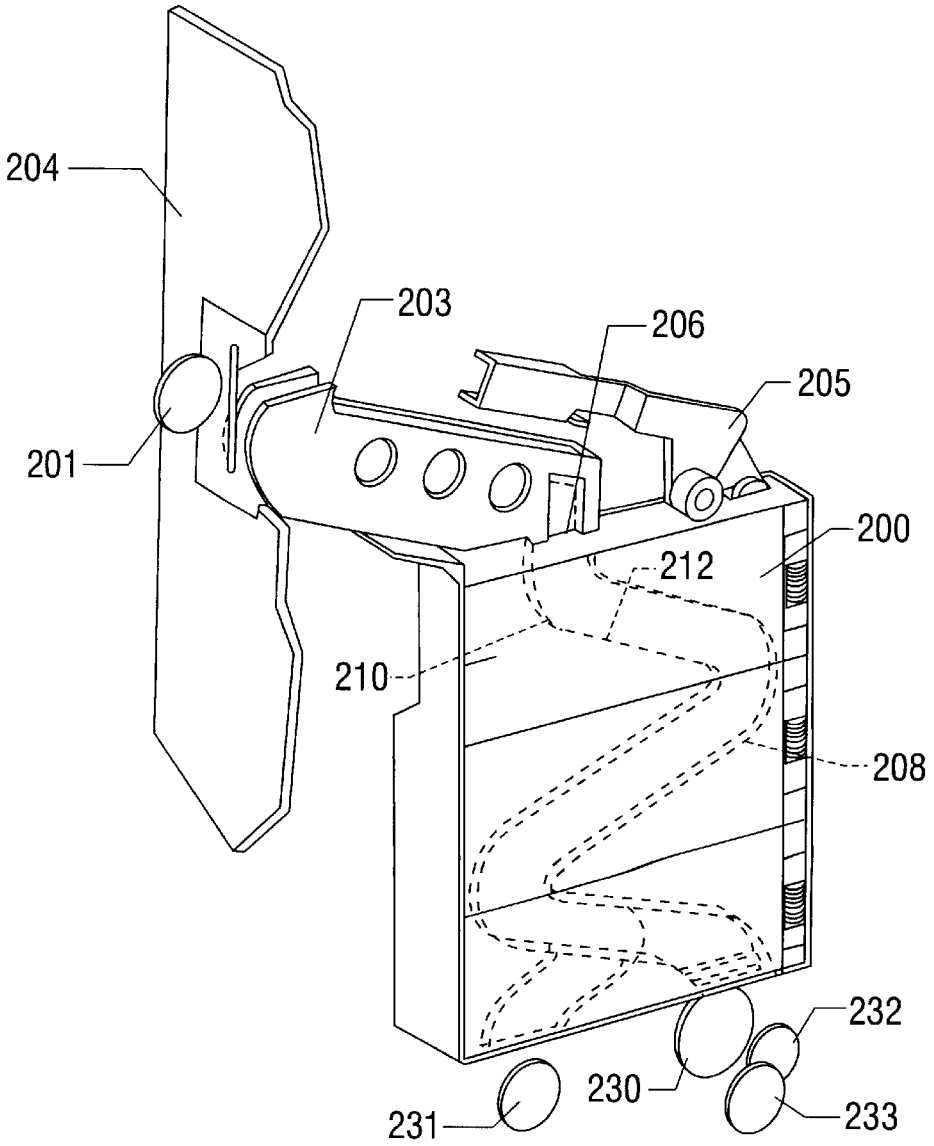
FIG. 14 is a perspective view of a second preferred embodiment of the invention having multiple coin capability.
Figure 15:
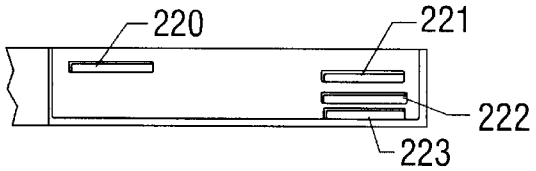
FIG. 15 is a bottom view of the embodiment illustrated in FIG. 14.

As seen in FIG. 14, this embodiment is also adapted to replace existing coin rejectors presently utilized in existing vending machines. The apparatus illustrated in FIG. 14 includes a cutaway view of a vending machine panel 204, a coin slot neck 203, and coin inlet 206 situated at the lower end of the neck 203 for accepting a given coin 201. This coin inlet 206 is formed in the upper portion of the rejector body 200.

Figure 16:
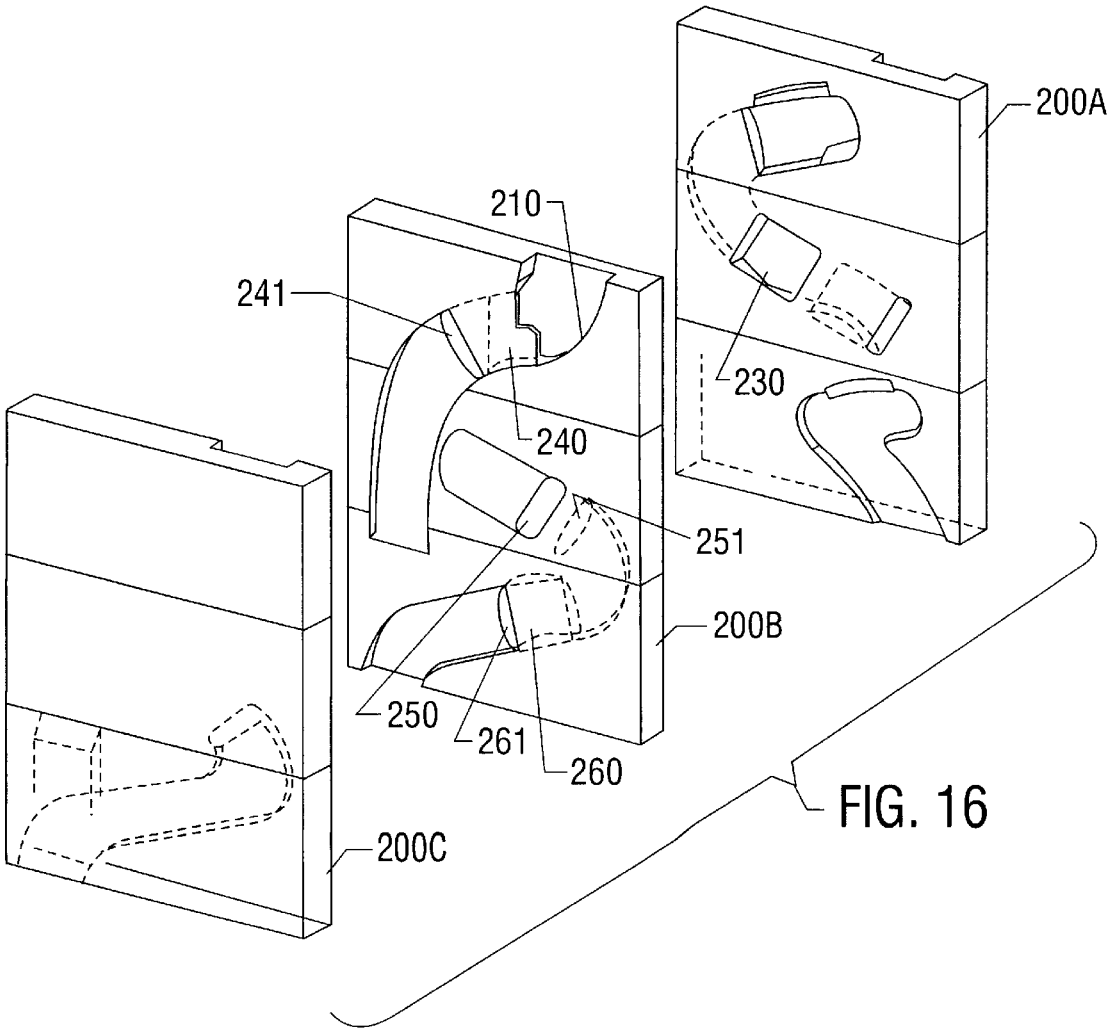
FIG. 16 is an exploded view of the preferred embodiment illustrated in FIG. 14.
Figure 17A:
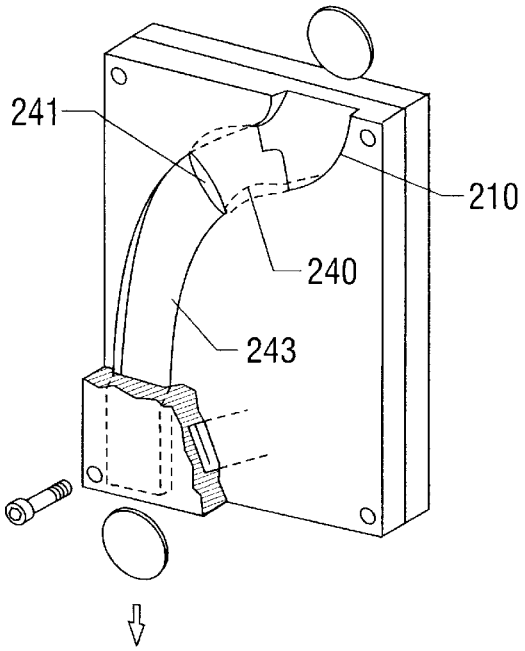
FIGS. 17 A–D are cutaway, perspective views of the embodiment shown in FIG. 14, illustrating the routing of various diameter coins as they pass through the rejector body.
Figure 17B:
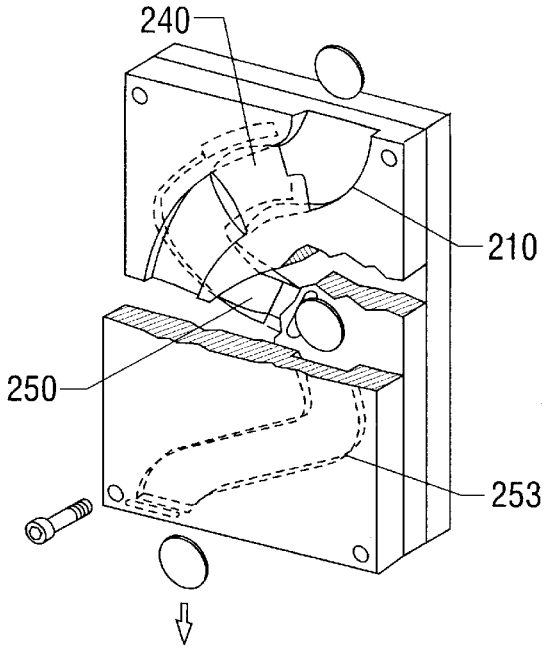
Figure 17C:
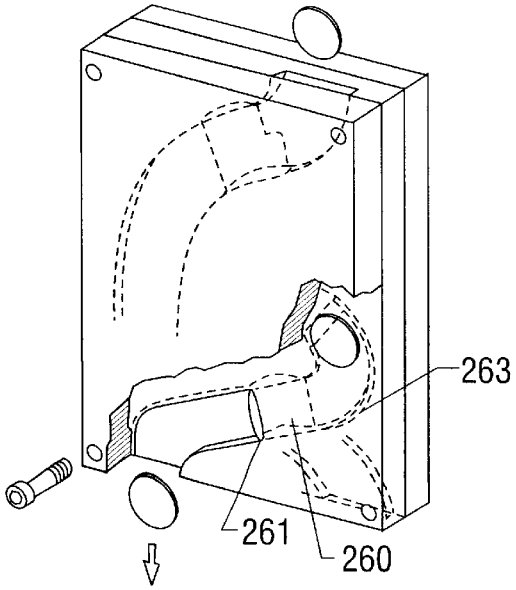
Figure 17D:
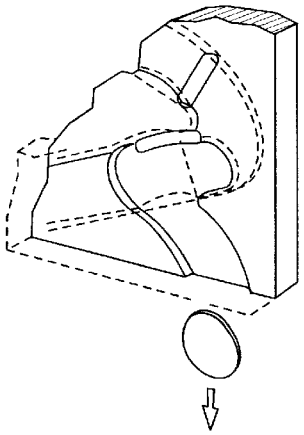

Referring to FIG. 16, the rejector body 200 itself is preferably formed of three separate plate assemblies, 200A–C, which are pivotally connected about one edge by a hinge (not shown), similar to that described in association with the embodiment illustrated in FIGS. 9–13. These plates may be held in close engagement by a suitable resilient means such as a hinge or the like (not shown). In such a fashion, the plates may be mechanically separated via lever 205 as previously described.

Similar to the embodiments previously described, this multiple coin embodiment is provided with a primary coin race 212. The coin race 212 defines a deflecting shoulder 210 at its upper extent and a plurality of outlets 220–223 at its lower extent. See FIG. 15. Preferably, this primary coin race 212 descends through the body in a cascade-like manner in order to organize the coins in their descent as they are processed by interaction with a number of protrusions and corresponding apertures.

Referring to FIGS. 16–17, this multiple coin embodiment is preferably adapted to differentiate and collect coins of four different denominations. Hence, a three-fold separation system is utilized, including the use of a primary protrusion 240 and associated aperture 241, a secondary protrusion 250 and aperture 251, and a tertiary protrusion 260 and aperture 261. These protrusions and adjacent apertures are situated in the primary 243, secondary 253, and tertiary 263 races, respectively, and operate in a manner previously described in association with the general embodiment.

For example, the protrusions situated along the individual races preferably define an upstream face having a line of contact (not shown) angularly oriented with respect to a line drawn normal to the primary race 212. This angulation is similar to that previously described in association with FIGS. 9–13. In this embodiment also, apertures 241, 251 and 261 are preferably framed by upper and lower retaining flanges, where the upper flange is arcuate in shape. Other features of the preferred embodiment previously described may also be incorporated.

Figure 18:
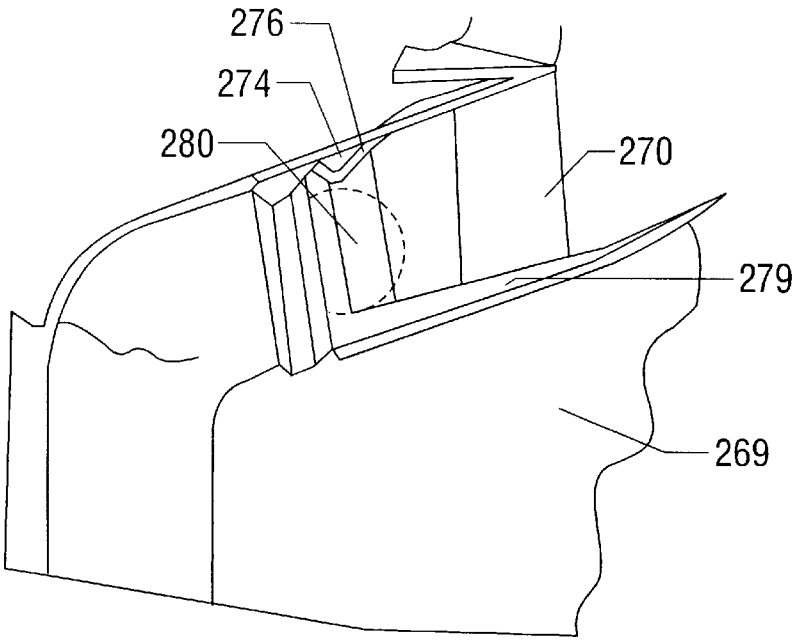
FIG. 18 is a cutaway, perspective view of a rejector employing a flange situated a selected height in the race for routing coins.
Figure 19:
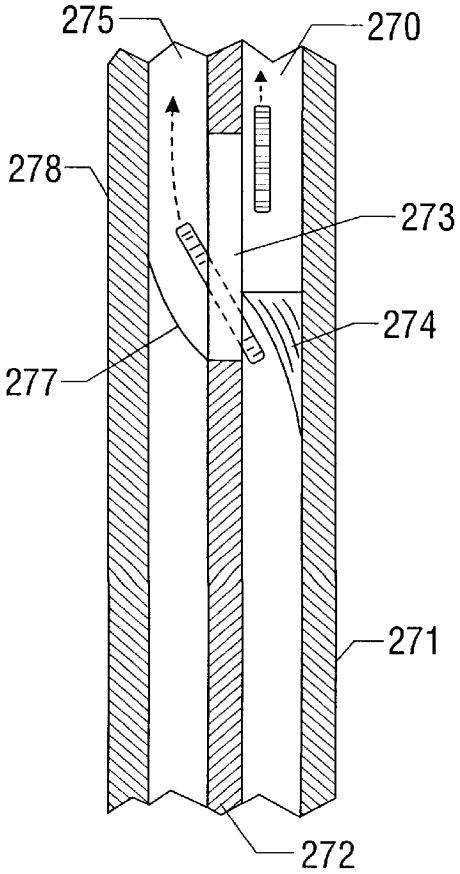
FIG. 19 is a schematic top view of the embodiment illustrated in FIG. 18 illustrating the movement of coins through the primary and secondary coin races.

Referring to FIGS. 18–19, a primary coin race 270 and secondary coin race 275, are downwardly formed in a rejector body 269 in a side-by-side relationship. Primary race 270 is comprised of two substantially parallel walls 271 and 272, respectively, which are spaced apart sufficiently from each other so as to enable the free, rotational, downward movement of coins, including bent or damaged coins. Though races 270 and 275 are illustrated as existing in a substantially parallel planar relationship in the rejector body 269, other relative spacial relationships of races 270 and 275 are also contemplated in accordance with the spirit of the present invention. In all embodiments, however, it is contemplated that the primary race 270 and secondary race 275 share a common wall, herein illustrated at 272, during that portion of the rejector body where coin separation into the two races is desired to take place. It will be understood by those of skill in the art that FIG. 19 (and FIGS. 20–21) are schematic diagrams and are not drawn to scale; rather the schematics are for the purpose of clearly illustrating the principles involved.

Referring to FIGS. 18 and 19, at that portion of the primary race where coin separation is desired, primary race 270 and secondary race 275 communicate through a common aperture 273 disposed in the common wall 272 as described above. Aperture 273 is situated generally opposite a deflecting flange 274 which is formed along and extends outwardly from a second wall 271 of the primary race 270. Preferably, flange 274 is offset from aperture 273 as illustrated so as to facilitate coin separation as will be further described. In a preferred embodiment, flange 274 extends laterally across the entirety of race 270 such that all coins of greater than a minimum diameter traveling downwardly along race 270 are forced to engage the curvilinear or arcuate surface of said flange 274 for the purpose of coin separation. Other embodiments requiring only substantial lateral extension of flange 274 are also believed possible, especially when other separating means are utilized.

As illustrated in FIGS. 18 and 19, deflecting flange 274 preferably adopts a curvilinear or arcuate shape when seen in top view section. As illustrated, flange 274 is provided with an upstream and downstream surface 276, said upstream surface substantially merging with the plane described by wall 271, while the downstream surface 30 extends laterally from wall 271. In a preferred embodiment, upstream and downstream surfaces of flange 274 are coupled in an arc like fashion as illustrated. In a preferred embodiment, deflecting flange 274 is formed integrally with wall 271, although it is envisioned that deflecting flange 274 may be separately formed. If separate manufacture or affixation of deflecting flange 274 is desired, the separator/rejector of the present invention may be readily modified to accept foreign coinage by the exchange of selected parts, including flange 274. Alternatively, separate manufacture enables the replacement of parts subject to greater wear.

The arcuate contact surface of flange 274 enables the smooth reorientation of coins 280 engaging its downstream contact surface 276. Coins thus engaging flange 274 are forced to adopt a travel path suggested by the downstream surface of flange 274, which surface preferably culminates at aperture 273. As the leading edge of a coin engages the flange, a lateral force is applied to the coin causing it to pivot on its axis such that the leading edge of the coin is aligned with the aperture. The tolerances of the race are such that the lateral movement of the trailing edge of the coin is controlled such that the coin's alignment with aperture is maintained. In such a fashion, the general attitude of coin 280 engaging flange 274 is altered, thereby enabling coin 280 to travel from primary race 270 through aperture 273 into secondary race 275. Accordingly, aperture 273 is of a sufficient configuration and size so as to allow the movement of larger diameter coins 280 from the primary race 270 into the secondary race 275, taking into consideration the clearance tolerances necessitated by variations in the speed and relative orientation of coins encountering flange 274.

To assure the smooth traverse of coins from the primary race 270 to secondary race 275, secondary race 275 may be provided with a receiving shoulder 277 such as that described in connection with FIGS. 1–8. In a preferred embodiment, shoulder 277 is arcuate in shape with the downstream surface of said shoulder substantially parallel or flush with the outside wall 278 of secondary race 275. In such a fashion, coins negotiating aperture 273 may be realigned in a direction generally parallel with races 270 and 275 such that the coins may continue downwardly in the rejector body for rejection or credit. As described in relation to primary race 270, secondary race 275 is also preferably provided with walls spaced apart a sufficient distance so as to allow the downward, rotational movement of coins, including the passage of bent or damaged coins while maintaining the coins in a substantially on-edge orientation.

In a preferred embodiment, deflecting flange 274 is preferably situated a selected distance h above the floor or track 279 of the primary race 270 so as to engage all coins 280 having a minimum diameter equal to or greater than h. In such a fashion, larger coins 280 contact flange 274 and are directed though aperture 273 into the secondary coin race 280 as earlier described. Coins having a diameter less than a selected height h do not contact and thus pass under deflecting flange 274. Absent lateral deflection, smaller coins bypass aperture 273 and continue along primary race 270 for further processing or credit.

Figure 20:
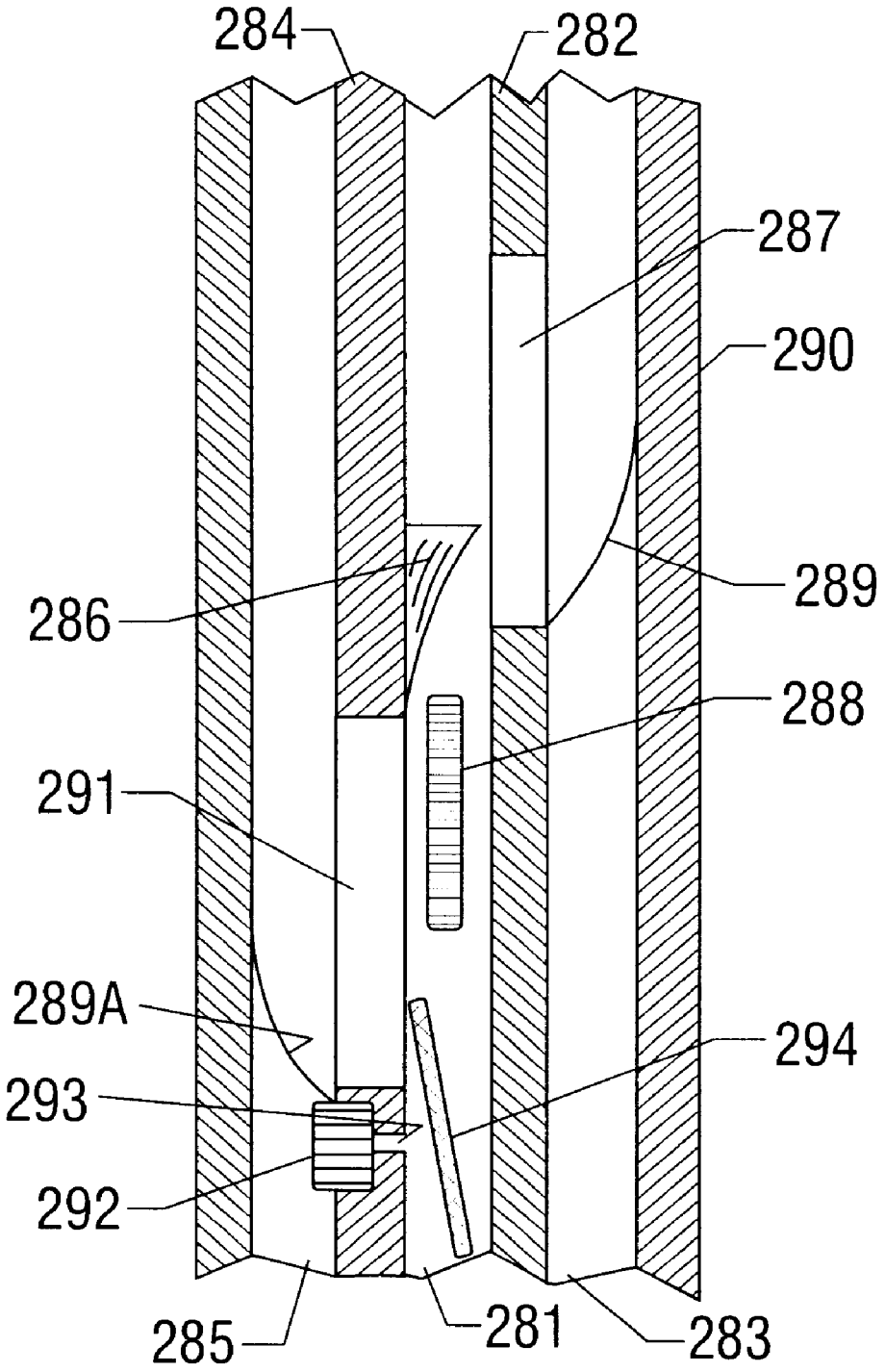
FIG. 20 is a schematic top view of an alternative embodiment of the present invention illustrating the supplemental use of a magnet for the purpose of separation.

FIG. 20 generally illustrates a top view of a second embodiment utilizing a supplemental deflecting means for removing ferrous coins, tokens and slugs from the primary race and moving said objects into a third or supplemental race for rejection or return of the coin to the customer. Though the embodiment illustrated in FIG. 20 is shown in combination with a deflecting flange as described above in relation to FIGS. 18 and 19, it is also envisioned that this means for rejecting ferrous coins, tokens, etc will have significant independent application, or alternatively, application with other separating/rejecting mechanisms.

As illustrated in FIG. 20, a primary race 281, secondary race 283, and a tertiary race 285 are disposed in a rejector body 290 in a side-by-side relationship. Though races 281, 283, and 285 are shown to exist in a parallel relationship to each other, other relative alignments of these races are also contemplated in accordance with the spirit of the present invention. As illustrated, secondary race 283 and tertiary race 285 share a common wall, 282 and 284, respectively, with the primary race 281. For purposes of the separating means of the invention, it is envisioned that each of the secondary or tertiary races, alone or concurrently, share a common wall with the primary race 281 or with each other in that portion of the rejector where separation of coins is desired. For example, it is envisioned that a secondary race be bordered by a primary and tertiary race so that the primary and tertiary races would each share a common opposite wall with the secondary race.

Primary 281, secondary 283, and tertiary races 285 generally each include a pair or walls situated generally parallel to each other, and a coin track or floor (not shown) on which the coins move downwardly in the rejector body. As earlier described, it is preferred that the walls of the individual coin races be spaced sufficiently apart from each other so as to allow the downward movement of bent or damaged coins. Otherwise, the race walls are dimensioned to retain coins in a substantially on-edge orientation. In such a fashion, jamming of coins in the rejector body is minimized.

As illustrated in FIG. 20, a deflecting flange 286 is situated along one wall 284 of primary race 281 relative to an aperture 287 disposed in opposite wall 282. Consistent with the embodiment illustrated in association with FIGS. 18 and 19, aperture 287 allows communication between the primary race 281 and secondary race 283, so as to allow the passage of coins therebetween. Deflecting flange 286 is preferably situated at a height h above the track or floor of primary race 281 so as to engage and redirect coins 288 having a selected minimum diameter through aperture 287 into secondary race 283. As previously described, a receiving shoulder 289 can be used in conjunction with aperture 287 to ensure the maintenance of positive control over the coin as it passes into the secondary race. Coins 288 having a diameter less than a selected minimum diameter pass underneath flange 286 and continue along race 281 for further processing and/or credit.

In the embodiment illustrated in FIG. 20, tertiary race 285 is formed on the opposite side of primary race 281 from secondary race 283. Tertiary race 285 communicates with primary coin race 281 via an aperture 291 disposed therebetween. Preferably, aperture 291 is situated upstream from deflecting flange 286 as illustrated, although other relative juxtapositions are contemplated within the spirit of the present invention. Again, a receiving shoulder 289A can be used to maintain positive control over coins entering race 285.

In the embodiment illustrated in FIG. 20, a second deflecting means 292, i.e., a magnet, is situated upstream from aperture 291. In instances where wall 284 is formed of a material allowing the effect of magnetism to easily pass through said wall, e.g., plastic, nylon or metal, magnet 292 may be affixed to the opposite side of wall 284, or alternatively, embedded in wall 284 as shown. In instances where a stronger magnetic field is required to effect larger or heavier coins, a small aperture 293 may be provided in wall 284 so as to more readily allow the effect of the field created by magnet 292 to be exerted on ferrous coins 294 moving along the primary race 281.

It is contemplated that it may be desirable to vary the strength of the magnetic field exerted upon ferrous coins or tokens depending on the given application of the rejector and also taking into account the type of coins generally encountered in a given area. In some cases, it may be necessary to utilize the fullest magnetic potential to remove ferrous coins or tokens alloyed with non-ferrous materials, e.g., nickel. In other incidences where iron or steel tokens are prevalent, it may be desirable to decrease the magnetic field so as to prevent coins from adhering to the magnet 292 itself, and thus causing the rejector to jam. To accommodate the variability in the magnetic fields exerted upon coins passing along primary race 281, magnet 292 may be slidably positioned in the wall 284 so as to allow lateral movement. When a stronger magnetic field is desired, the magnet may be moved in the wall to a position closer to the primary race 281. When a weaker magnetic field is desired, magnet 292 may be moved away from the primary race 281.

The operation of the embodiment illustrated in FIG. 20 may be generally described as follows. Coins of various denominations, e.g., quarters, nickels, dimes and pennies, are inserted in a solitary coin inlet (not shown) at the upstream extent of the rejector and ultimately move downwardly along the primary race 281. Larger non-ferrous coins having a diameter at least equal to the height h engage flange 286 and are redirected through aperture 287 into secondary race 283 whereupon the coins are collected for credit, or in cases where flange 286 is positioned at a height to differentiate desired currency from oversized coins, slugs or tokens, coins directed into secondary race are rejected or returned to the customer.

Ferrous coins, slugs or tokens inserted in the rejector also pass along primary race 281 and move downwardly toward deflecting flange 286. These coins, however, are deflected from their direct, downward travel by the field emanating from magnet 292 and are redirected through aperture 291 into tertiary race 285 for rejection and return to the customer.

Figure 21:
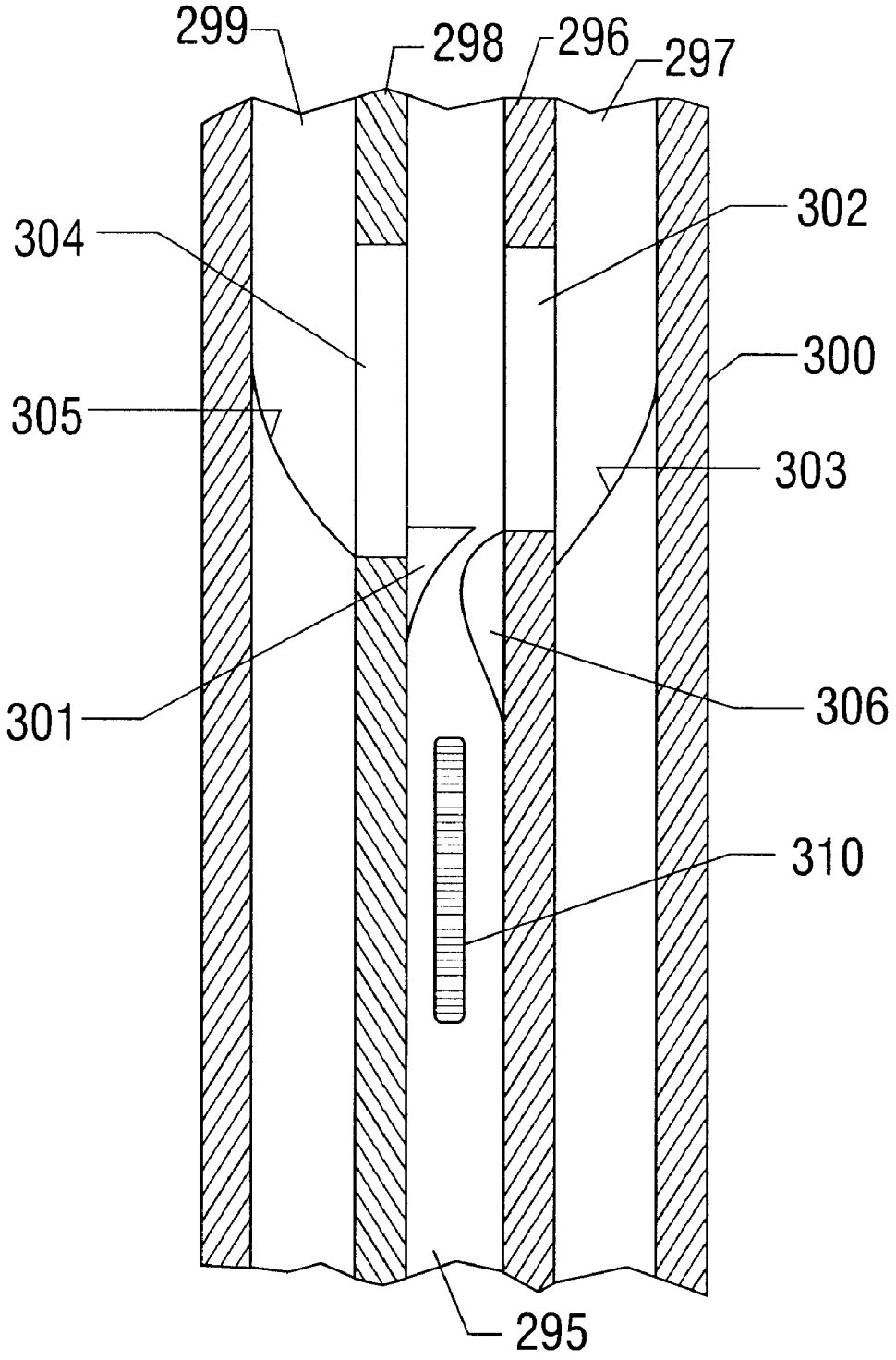
FIG. 21 is a schematic top view of a third embodiment illustrating simultaneous separation.

FIG. 21 illustrates an apparatus for simultaneous separation of coins of various diameters. Since domestic coinage, as well as foreign coinage, are generally differentiated according to coin diameter, this embodiment can simultaneously separate coin denominations as well as reject odd sized coins, tokens, etc. In such a fashion, the overall size of the rejector body may be reduced. It is envisioned that this embodiment of the invention may be used individually or in combination with the other separating and rejecting mechanisms.

FIG. 21 illustrates a primary race 295, a secondary race 297, and a tertiary race 299 disposed in a rejector body 300 in a side-by-side fashion. As earlier noted, it is preferred but not necessary that races 295, 297, and 299 be situated in a parallel relationship. It is, however, desirable that the secondary race 297 and tertiary race 299 be situated on opposite sides of primary race 295 so as to share a common wall with race 295 at a region in the rejector where coin separation is desired.

The primary, secondary, and tertiary races preferably include a pair of walls 296 and 298 oriented in a parallel fashion, and spaced apart sufficiently to allow the passage of bent or damaged coins therealong while maintaining the coins in a substantially on-edge orientation. In a preferred embodiment, a coin deflecting flange 301 is situated along wall 298 of the primary race 295. Consistent with the embodiments earlier described, deflecting flange 301 is positioned at a height h above the track or floor of primary race 295 so as to engage coins 310 having at least a minimum diameter. A complementary aperture 302 is disposed in wall 296 opposite deflecting flange 301 so as to compel the movement of larger coins through aperture 302 and into secondary race 297 as earlier described. As described previously, a receiving shoulder 303 can be used in conjunction with the aperture to ensure a smooth transition into the secondary race while maintaining positive control over the lateral stability of the coin. A second aperture 304 is disposed in wall 298 so as to allow communication between the primary race 295 and tertiary race 299. Receiving shoulder 305 is shown in cooperation with aperture 304.

In a preferred embodiment, a coin deflecting protrusion 306 is situated in primary race 295 on wall 296 opposite deflecting flange 301. Preferably, protrusion 306 is situated upstream from aperture 302, and opposite and upstream from aperture 304 as shown. Although not shown, the overall lateral extent of protrusion 306 preferably overlaps with the lateral extension of flange 301. It is also preferred that protrusion 306 be displaced or offset from flange 301 a sufficient distance to eliminate or minimize the possibility of jamming. As will be appreciated by those of skill in the art, the illustrations are not to scale for purposes of clearly illustrating the principles involved.

The overall configuration of protrusion 306 may be seen by reference to FIGS. 1–8. In general terms, protrusion 306 is adapted to change both the attitude and direction of travel of coins engaging its upstream contact surface, thereby redirecting said coins toward aperture 304.

Unlike aperture 302 which is adapted to receive larger coins and hence may adopt a vertical height equal to that of the primary race itself, aperture 304 is preferably formed of a size so as to prohibit the introduction of coins having a diameter greater than a maximum diameter s. In such a fashion, smaller coins having a maximum diameter less that s are deflected through aperture 304 into tertiary race 299.

The operation of the invention illustrated in FIG. 21 may be described as follows. Coins of various denominations, e.g., quarters, nickels, dimes and pennies, are inserted through the solitary coin inlet portal (not shown) and pass downwardly along primary coin race 295. The leading edge of each coin engages the curvilinear surface of protrusion 306 and the leading edge of the coin is aligned with aperture 304. Coins having a maximum diameter at least equal to h are moved into contacting relationship with the deflecting flange 301 which then directs the coins through aperture 302 into secondary race 297 for further processing, credit or return. Coins having a diameter less than h pass underneath flange 301 where they are moved toward aperture 304. If the coin has a diameter greater than s, the size of aperture 304 serves as a barrier to the coin which then continues to move downwardly along primary race 295. Coins having a diameter less than s pass through aperture 304 for further processing, credit or return.

Referring to FIGS. 22-30, an acceptor/rejector is shown that is designed to accept a single denomination of coin, such as a quarter, and to reject all others that are of larger of smaller diameter. Specifically, oversized and undersized coins are separated through the same aperture while retaining the desired coin in the primary race. The embodiment illustrated is especially suited for use in game machines, such as video games, that are often subjected to tilting or jarring, and includes an anti-cheat component that inhibits undersized coins from being retained in the primary race through tilting or jarring of the acceptor/rejector.

Figure 22:
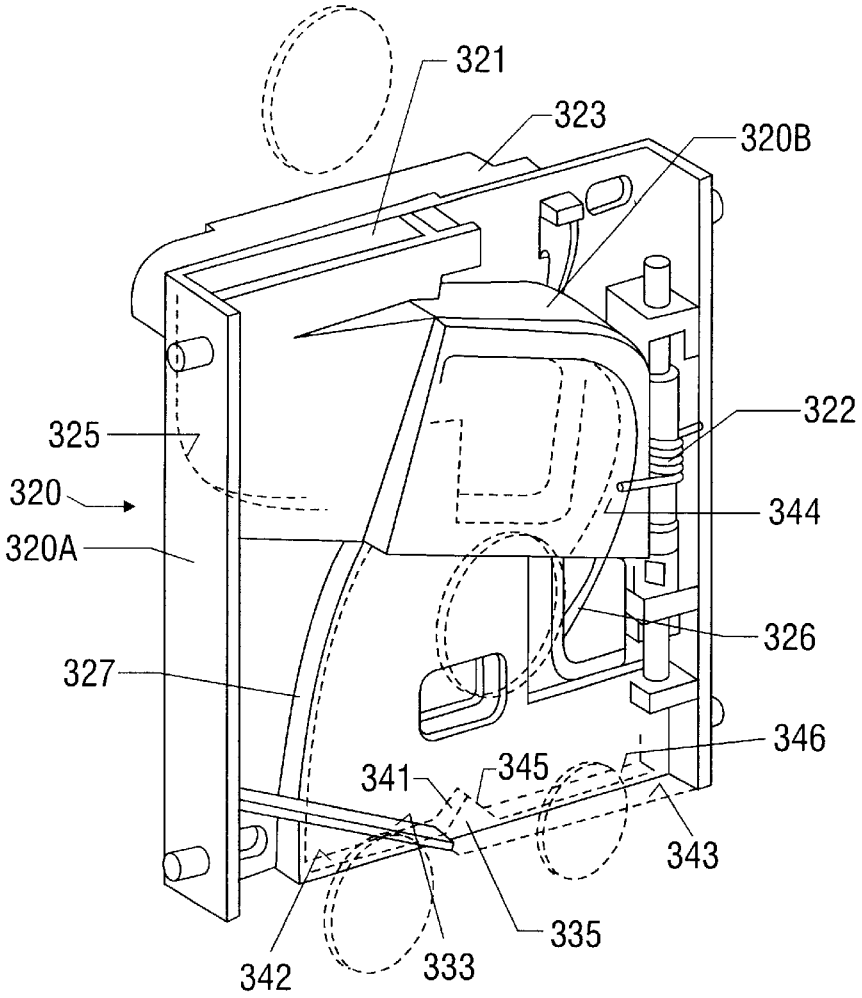
FIG. 22 is a perspective view of a rejector body adapted to separate oversized and undersized coins through the same aperture.

Referring to FIG. 22, a rejector body 320 is shown having rejector body components 320A and 320B biased together with spring 322. A levering means 323 can be depressed to wedge the rejector body components apart, thereby allowing stuck coins to drop from the rejector body. The rejector body and levering means illustrated are adapted to fit into standard acceptor/rejector body housings in video game machines.

Figure 23:
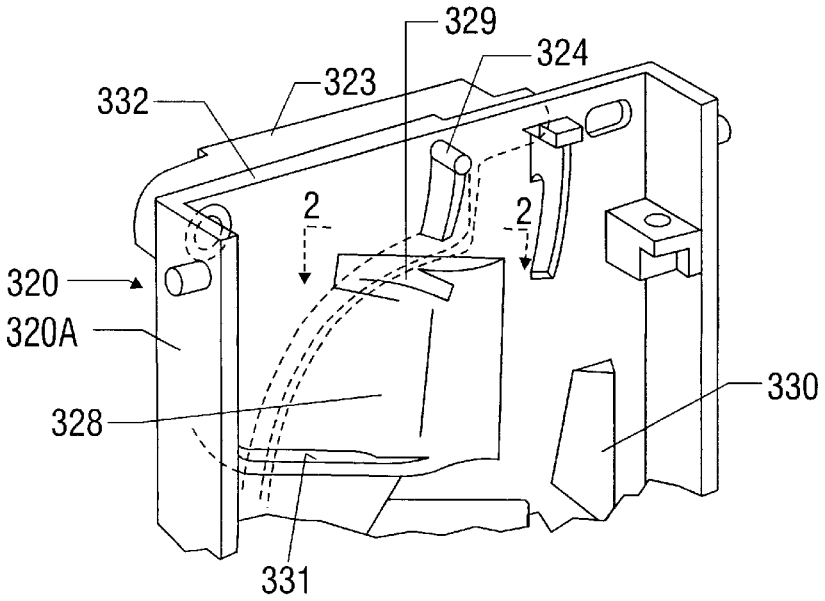
FIG. 23 is a partial perspective view of the rejector illustrated in FIG. 22.
Figure 24:
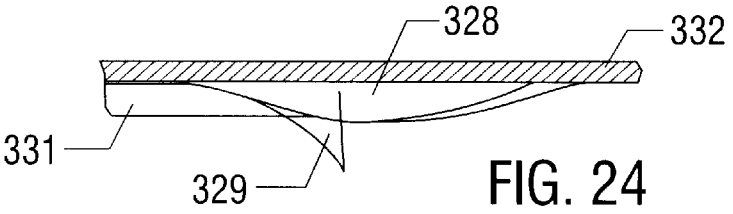
FIG. 24 is a top view taken along line 2—2 of FIG. 23.
Figure 25:
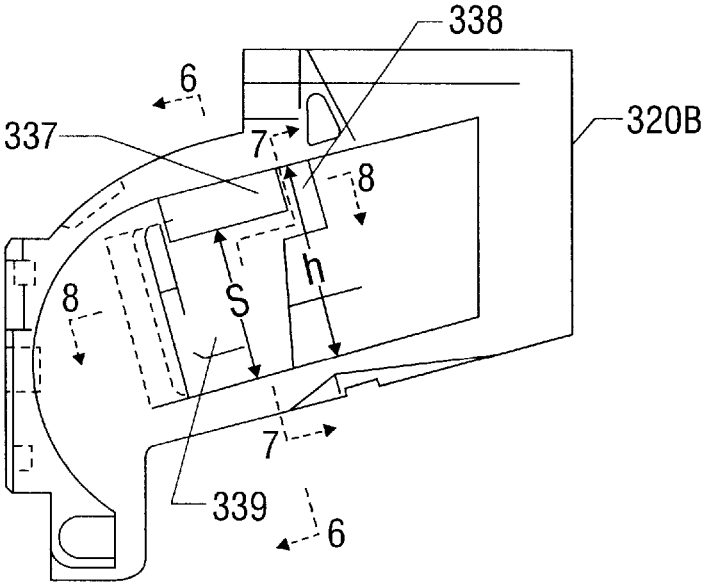
FIG. 25 is an internal side view of section 320B shown in FIG. 22.
Figure 26:
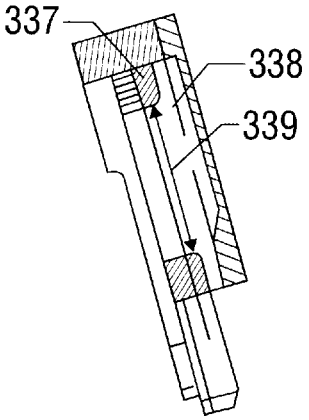
FIG. 26 is a cross section taken along line 6—6 of FIG. 25.
Figure 27:
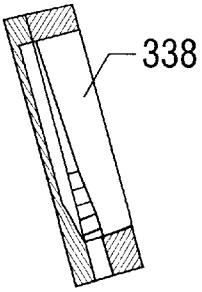
FIG. 27 is a cross section taken along line 7—7 of FIG. 25.
Figure 28:
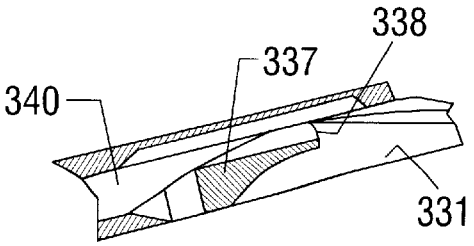
FIG. 28 is a cross section taken along line 8—8 of FIG. 25.

Referring to FIGS. 22–24, coin inlet 321 communicates with the primary race. The route of the primary race can be determined generally by reference to the receiving shoulder 325, coin track 331, coin tracks 326 and 327, and shoulder 341 on protrusion 335. The walls of the race are dimensioned to allow a coin to proceed through the race while maintaining the coin in a substantially on-edge orientation. Coins deposited in the rejector body having the selected diameter for acceptance are retained in the primary race and exit the rejector body through portal 342.

Referring to FIGS. 23–24, each coin entering the rejector body rolls along track 331 and encounters curvilinear protrusion 328 extending from wall 332 which exerts a lateral force to the leading edge of the coin. If the coin is of a diameter greater than the desired diameter for acceptance, the leading edge of the coin also encounters flange 329, which provides an extended curvilinear surface for oversized coins. Accordingly, the path of each coin proceeding down track 331 is altered, and the leading edge of each coin aligned in its new direction, according to whether the leading edge of the coin encounters only protrusion 328, or the protrusion and flange 329. An inherent feature of using the curvilinear, or arcuate, shaped protrusions in conjunction with races that are dimensioned to keep the coins in substantially on-edge orientation is the ability to align the leading edge of the coin with a new direction of travel while maintaining the lateral stability of the trailing edge of the coin by adjusting the tolerances of the race to ensure that not only the direction of the coin's travel is along the intended path, but that the alignment of the coin's leading edge is in conformance with its direction of travel. In other words, skidding or slipping of the coin as it pivots on its axis is kept to a minimum such that the alignment of the coin is consistent with its path of travel.

Referring to FIGS. 22–28, once the coins proceeding down track 331 encounter protrusion 328, the coins are aligned with aperture 339 and three things can happen depending on the diameter of the coin. Coins of a diameter greater than the diameter selected for acceptance also encounter flange 329, having an extended curvilinear surface from protrusion 328, which aligns the leading edge of the coin with aperture portion 338. These coins pass behind retaining flange 337 and into the secondary race shown generally defined by tracks 340 and 344 and exits the rejector body through portal 343 via ramp 333. Coins of a diameter selected for acceptance pass under flange 329 and then encounter retaining flange 337 which is positioned above the primary race track a sufficient distance to allow coins of less than the selected diameter to pass beneath retaining flange 337. Accordingly, coins of the selected diameter are retained in the primary race by retaining flange 337 and exit through portal 342. Coins of less than the selected diameter pass beneath flange 337 and into the secondary race as do the oversized coins, and exit the rejector body through portal 343.

In many instances a rejector body is subjected to tilting or jarring such as when the rejector is used in coin activated games. In such circumstances, an undersized coin might be retained in the primary race by tilting the rejector body such that the undersized coin follows the curvilinear protrusion 328 without the assistance of retaining flange 337.

Coins of a smaller diameter than the desired coin for acceptance which are retained in the primary race through jarring or tilting can be separated by a system of protrusions positioned in the primary race and adapted to selectively engage coins of different diameters. In one embodiment, two protrusions are positioned in the primary race and adapted to engage the edges of coins of the desired diameter. A third protrusion is positioned intermediate the first two protrusions. The first two protrusions are adapted to guide the coins of the desired diameter out of contact with the intermediately positioned protrusion and along a path leading to the desired exit. Coins of a diameter less than the desired coin's diameter are not guided out of contact by the effect of the first two protrusions, and the intermediately positioned protrusion guides the smaller diameter coins to an alternative exit. This aspect of the invention is further illustrated below.

Figure 29:
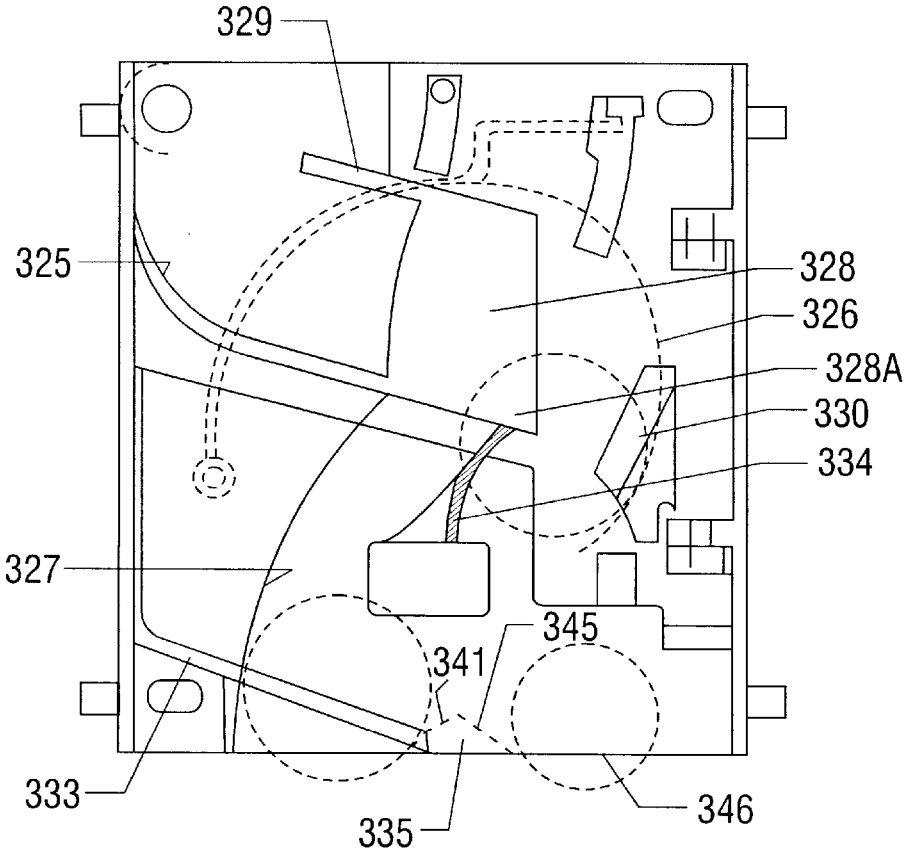
FIG. 29 is a side view of section 320A shown in FIG. 22.
Figure 30:
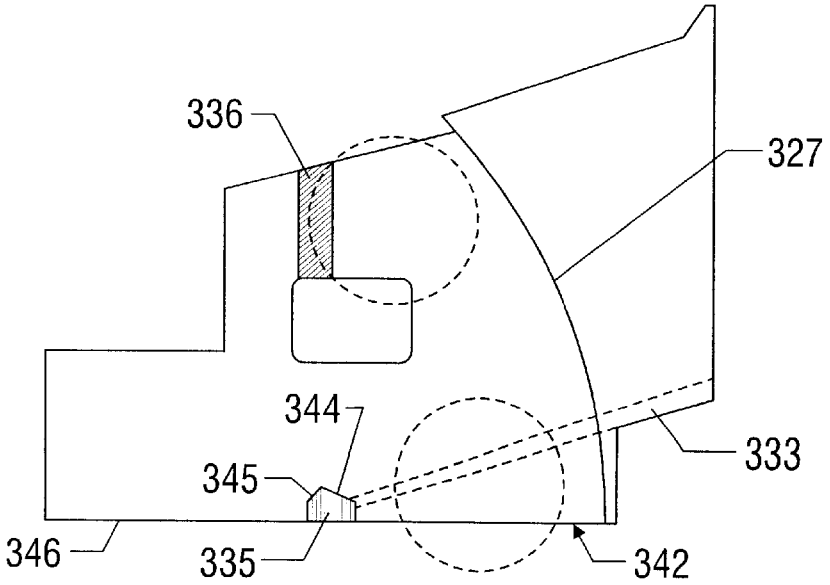
FIG. 30 is an opposite side view of a portion of section 320A shown in FIG. 22.

Referring to FIGS. 29–30, coins traveling past aperture 339 and proceeding down the primary race approach protrusions 330, 334 and 336. The surfaces of the protrusions are angled as necessary to ensure a smooth transition of the coins as they engage the protrusions. Each coin proceeding down the primary race encounters protrusion 330, assisted by track 326 between the race walls. Coins of the selected diameter for acceptance have one edge engaged with area 328A on protrusion 328 as the coin's edge also engages protrusion 330 and the coin is guided out of contact with protrusion 334 and guided on its way with the assistance of protrusion 336 which aids in maintaining the alignment of the coin. Accordingly, such coins are launched in a direction of travel defined generally by tracks 326, 327 and shoulder 341 on protrusion 335. The edges of coins of less than the selected diameter engage only protrusion 330 and therefore are not guided out of contact with protrusion 334 with the assistance of area 328A. Thus, coins of less than the selected diameter encounter the edge of protrusion 334 and drop from the rejector body along a coin race generally defined by shoulder 345 on protrusion 335 and exit the rejector body through portal 346.

From the illustrated embodiments, those of skill in the art will recognize other alternative embodiments and all such embodiments are included in the scope of this invention.

What is claimed is:

1. A method of removing a coin of a selected diameter from a primary coin race and into a secondary coin race, comprising:

(a) inserting a coin of a selected diameter into a downwardly inclined primary coin race having walls dimensioned to retain said coin in a substantially on-edge orientation, said coin race having an aperture in a wall of said race dimensioned to pass coins of said selected diameter, said aperture in communication with a downwardly inclined secondary coin race having walls dimensioned to retain said coins of a selected diameter in a substantially on-edge orientation; and (b) aligning said coin with said aperture and directing said coin of selected diameter through said aperture while maintaining said coin in its substantially on-edge orientation by (i) pivoting said coin on its vertical axis by applying a lateral force to the leading edge of said coin with a curvilinear protrusion extending into said race and adjacent said aperture, said curvilinear protrusion configured to align the leading edge of said coin with said aperture; and (ii) simultaneously controlling the lateral movement of the trailing edge of said coin to maintain the alignment of the leading edge of said coin with said aperture.

2. A coin separator and rejector comprising:

(a) a rejector body having an inlet coin portal in an upper portion thereof;

(b) a downwardly inclined primary coin race having a pair of walls dimensioned to retain coins in the race in a substantially on-edge orientation, said race positioned in the rejector body in a generally vertical disposition below the inlet portal and adapted to receive coins from the portal;

(c) a secondary coin race having a pair of walls dimensioned to retain coins in the race in a substantially on-edge orientation positioned in the rejector body and connected to the primary coin race by a common aperture between adjacent walls of the two races, said aperture generally having a top and a bottom;

(d) means for applying a lateral force to the leading edge of a coin traveling down the primary coin race to pivot the coin on its vertical axis and to align the leading edge of the coin with the aperture while maintaining the coin in a substantially on-edge orientation; and (e) a retaining member proximate said aperture for retaining coins of at least a first diameter in said primary coin race, while allowing coins of a lesser diameter to pass thorough said aperture into said securing coin race.

3. The separator and rejector of claim 2 further comprising means for pre-aligning the coin upstream of said aperture.

4. A coin separator and rejector comprising:

(a) a rejector body having an inlet coin portal in an upper portion thereof;

(b) a downwardly inclined primary coin race having a pair of walls dimensioned to retain coins in the race in a substantially on-edge orientation positioned in the body in a generally vertical disposition below the inlet portal and adapted to receive coins from the portal;

(c) a secondary coin race having a pair of walls dimensioned to retain coins in the race in a substantially on-edge orientation positioned in the rejector body and connected to the primary coin race by a first coin receiving common aperture formed in the walls of the two races, said first aperture generally having a top and a bottom;

(d) a first curvilinear protrusion situated along the primary coin race and positioned downstream from the inlet portal and proximate said first aperture, said first curvilinear protrusion adapted to pivot a coin traveling down the primary race generally on its vertical axis and to align the leading edge of said coin with the first aperture while maintaining said coin in a substantially vertical on-edge orientation;

(e) means for controlling the lateral movement of the trailing edge of said coin to maintain the alignment of the leading edge of said coin with the aperture; and (f) means for redirecting coins of at least a selected minimum diameter that are aligned with the aperture and for retaining said coins in the primary race while maintaining said coins in a substantially vertical on-edge orientation.

5. The separator and rejector of claim 4, further comprising (a) a tertiary coin race having a pair of walls dimensioned to retain coins in the race in a substantially on-edge orientation positioned in the rejector body and connected to the secondary coin race by a second coin receiving common aperture formed in the walls of the secondary and tertiary races, said second aperture generally having a top and a bottom;

(b) a third curvilinear protrusion situated along the secondary coin race and positioned downstream from the first aperture and proximate the second aperture, said third curvilinear protrusion adapted to pivot a coin smaller than the first selected minimum diameter traveling through the first aperture and down the secondary race on its vertical axis and to align the leading edge of said coin with the aperture while maintaining said coin in a substantially vertical on-edge orientation; and (c) means for controlling the lateral movement of the trailing edge of said coin in said secondary coin race to maintain the alignment of the leading edge of said coin with the second aperture.

6. The separator and rejector of claim 5, further comprising means for redirecting a coin of at least a selected minimum diameter smaller than said first minimum diameter that is aligned with the second aperture between the secondary and tertiary races and for retaining said coin in the secondary race while maintaining said coin in a substantially vertical on-edge orientation.

7. A coin separator and rejector, comprising:

a rejector body having an inlet coin portal in an upper portion thereof;

a downwardly inclined primary coin race having a pair of walls dimensioned to retain coins in the race in a substantially on-edge orientation positioned in the body in a generally vertical disposition below the inlet portal and adapted to receive coins form the portal;

a secondary coin race having a pair of walls dimensioned to retain coins in the race in a substantially on-edge orientation positioned in the rejector body and connected to the primary coin race by a common aperture formed in the walls of the two races, said aperture generally having a top and a bottom;

a first curvilinear protrusion situated alone the primary coin race and positioned downstream from the inlet portal and proximate the aperture, said curvilinear protrusion adapted to pivot a coin traveling down the primary race generally on its vertical axis and to align the leading edge of said coin with the aperture while maintaining said coin in a substantially vertical on-edge orientation;

a second curvilinear protrusion extending from a wall of the primary race upstream of said aperture, said protrusion adapted to pre-align coins traveling down said primary race for engagement with said curvilinear protrusion proximate said aperture;

means for controlling the lateral movement of the trailing edge of said coin to maintain the alignment of the leading edge of said coin with the aperture; and means for redirecting coins of at least a selected minimum diameter that are aligned with the aperture and retaining said coins in the primary race while maintaining said coins in a substantially vertical on-edge orientation.

8. A coin separator and rejector, comprising:

(a) a rejector body having a coin inlet portal disposed in the upper portion thereof;

(b) a downwardly inclined primary coin race having a pair of walls dimensioned to retain coins in the race in a substantially on-edge orientation positioned in the body in a generally vertical disposition below the inlet portal and adapted to receive coins from the portal;

(c) a secondary coin race having a pair of walls dimensioned to retain coins in the race in a substantially on-edge orientation positioned in the rejector body and connected to the primary coin race by a first common aperture formed in the walls of the two races, said first aperture generally having a top and a bottom;

(d) a flange extending from the wall of said primary race and generally above said aperture, said flange positioned a selected height in the race to engage the edge of a coin of a selected minimum diameter while allowing coins of less than the selected minimum diameter to pass beneath the flange, said flange presenting a curvilinear surface to said coin of a selected minimum diameter such that a coin engaging said curvilinear surface has a lateral force applied to its leading edge such that said coin is pivoted on a generally vertical axis while maintaining said coin in a substantially on-edge orientation; and (e) said pair of walls of said primary coin race cooperatively spaced from one another proximate said aperture to control the lateral movement of the trailing edge of said coin engaging said flange.

9. The separator and rejector of claim 8, further comprising:

(a) a tertiary coin race having a pair of walls dimensioned to retain coins in the race in a substantially on-edge orientation positioned in the rejector body and connected to the primary coin race by a second common aperture formed in the walls of the primary and tertiary races, said second aperture generally having a top and a bottom; and (b) a magnet positioned upstream of the second aperture between the primary and tertiary races such that coins attracted by the magnet are deflected through the second aperture into the tertiary race in a substantially on edge orientation.

10. The separator and rejector of claim 9 wherein the magnet is slidably positioned in the wall upstream of the second aperture between the primary and tertiary races.

11. A coin separator and rejector configured to separate coins of different sizes, comprising:

(a) a rejector body having a coin inlet portal disposed in the upper portion thereof;

(b) a downwardly inclined primary coin race having a pair of walls dimensioned to retain coins in the race in a substantially on-edge orientation positioned in the body in a generally vertical disposition below the inlet portal and adapted to receive coins from the portal;

(c) a secondary coin race having a pair of walls dimensioned to retain coins in the race in a substantially on-edge orientation positioned in the rejector body and connected to the primary coin race by a common aperture formed in the walls of the two races, said aperture generally having a top and a bottom allowing coins of less than a predetermined diameter to pass therethrough; and (d) a magnet disposed in the wall of the primary race upstream and proximate said aperture and adapted to deflect magnetic coins of less than said predetermined diameter, from said primary race through said aperture and into said secondary race in a substantially on-edge orientation.

12. A coin separator and rejector, comprising:

(a) a rejector body having a coin inlet portal disposed in the upper portion thereof;

(b) a downwardly inclined primary coin race having a pair of walls dimensioned to retain coins in the race in a substantially on-edge orientation positioned in the body in a generally vertical disposition below the inlet portal and adapted to receive coins from the portal;

(c) a secondary coin race positioned in the rejector body having a pair of walls dimensioned to retain coins in the race in a substantially on-edge orientation and connected to the primary coin race by a first common aperture formed in the walls of the primary and secondary races, said aperture generally having a top and a bottom and dimensioned to pass coins of a first selected minimum diameter;

(d) a tertiary coin race positioned in the rejector body having a pair of walls dimensioned to retain coins in the race in a substantially on-edge orientation and connected to the primary coin race by a second common aperture formed in the walls of the primary and tertiary races, said second aperture generally having a top and a bottom and dimensioned to pass coins of a second selected minimum diameter, said first and second apertures positioned substantially opposite one another in the walls of the primary race;

(e) a first protrusion extending into said primary coin race, said protrusion configured to apply a lateral force to the leading edge of a coin of said first selected minimum diameter and to align said coin with said first aperture while maintaining said coin in a substantially on-edge orientation, said protrusion positioned upstream and proximate said first and second apertures; and (f) a second protrusion extending into said primary coin race, said protrusion configured to apply a lateral force to the leading edge of a coin of said second selected minimum diameter and to align said coin with said second aperture while maintaining said coin in a substantially on-edge orientation, said means positioned upstream and proximate said first and second aperture.

13. A coin separator and rejector, comprising:

(a) a rejector body having a coin inlet portal disposed in the upper portion thereof;

(b) a downwardly inclined primary coin race having a pair of walls dimensioned to retain coins in the race in a substantially on-edge orientation and positioned in the body in a generally vertical disposition below the inlet portal and adapted to receive coins from the portal;

(c) a secondary coin race positioned in the rejector body having a pair of walls dimensioned to retain coins in the race in a substantially on-edge orientation and connected to the primary coin race by a first common aperture formed in the walls of the primary and secondary races, said aperture generally having a top and a bottom and dimensioned to pass coins of a first selected maximum diameter;

(d) a tertiary coin race positioned in the rejector body having a pair of walls dimensioned to retain coins in the race in a substantially on-edge orientation and connected to the primary coin race by a second common aperture formed in the walls of the primary and tertiary races, said aperture generally having a top and a bottom and dimensioned to pass coins of a second selected maximum diameter, said second selected maximum diameter greater than said first selected maximum diameter, said first and second apertures positioned proximate one another in the walls of the primary race;

(e) a curvilinear protrusion situated along the primary coin race and positioned downstream from the inlet portal and proximate said first and second apertures, said curvilinear protrusion adapted to pivot a coin traveling down the primary race on its vertical axis and align the leading edge of said coin with said second aperture while maintaining said coin in a substantially vertical on-edge orientation;

(f) a curvilinear protrusion comprising a flange extending from the wall of said primary race and generally opposite said first aperture, said flange positioned a selected height in the race to engage the edge of a coin of said first selected minimum diameter while allowing coins of less than said first selected minimum diameter to pass beneath the flange, said flange presenting a curvilinear surface to said coin of said first selected minimum diameter such that said coin engaging said curvilinear surface has a lateral force applied to its leading edge such that said coin is pivoted on its vertical axis and the leading edge of said coin is aligned with said first aperture while maintaining said coin in a substantially on-edge orientation; and (g) means for controlling the lateral movement of the trailing edge of said coins engaging said curvilinear surfaces such that the alignment of the leading edge of said coins with said first or second apertures is maintained.

14. A coin separator and rejector comprising:

(a) a rejector body having an inlet coin portal in an upper portion thereof;

(b) a downwardly inclined primary coin race having a pair of walls dimensioned to retain coins in the race in a substantially on-edge orientation positioned in the body in a generally vertical disposition below the inlet portal and adapted to receive coins from the portal;

(c) a secondary coin race having a pair of walls dimensioned to retain coins in the race in a substantially on-edge orientation positioned in the rejector body and connected to the primary coin race by a common aperture formed in the walls of the two races, said aperture generally having a top and a bottom, a portion of said aperture dimensioned to pass coins of greater than a selected diameter, and another portion of said aperture dimensioned to accept coins of less than a selected diameter;

(d) a curvilinear protrusion situated along the primary coin race and positioned downstream from the inlet portal and proximate the aperture, an upper portion of said curvilinear protrusion adapted to pivot coins of greater than a selected diameter traveling down the primary race on their vertical axes and align the leading edge of said coins with the portion of the aperture dimensioned to pass coins of greater than a selected diameter while maintaining said coins in a substantially vertical on-edge orientation, a lower portion of said curvilinear protrusion adapted to pivot coins of less than a selected diameter traveling down the primary race in their vertical axes and to align the leading edge of said coins with the portion of the aperture dimensioned to pass coins of less than a selected diameter while maintaining said coins in a substantially vertical on-edge orientation.

15. A coin separator and rejector, comprising:

(a) a rejector body comprising a coin inlet and a first and second coin exit;

(b) a downwardly inclined primary coin race positioned in said rejector body having a pair of walls dimensioned to retain coins in a substantially on-edge orientation; and (c) a system of protrusions positioned in said primary coin race comprising a first and second protrusion positioned in said primary race and adapted to engage the edges of coins of a first diameter, and a third protrusion intermediate said first and second protrusions and adapted to engage the edges of coins of a diameter less than said first diameter, said first and second protrusions further adapted to guide coins of said first diameter out of contact with said third protrusion and to guide said coins to said first exit, and said third protrusion adapted to guide coins of said diameter less than said first diameter to said second exit.

16. Apparatus for separating coins of different diameters;

a non-magnetic rejector body including an inlet port in an upper part of the body adapted to receive coins separately and in sequence;

a vertically disposed, downwardly inclined, primary coin race positioned within the body to receive coins from the inlet part, said primary race having a pair of generally vertical walls laterally spaced to enable coins to move down the primary race in a generally vertical, on-edge manner;

a first coin receiving aperture having a top and bottom and positioned in the body between the primary race and an upper portion of the secondary race, said first aperture dimensioned to pass coins from the primary race into the secondary race;

a first protrusion on the wall of the primary race positioned opposite said first aperture and configured to direct a coin impacting the first protrusion through the first aperture while maintaining the coin in an on-edge orientation;

a first curvilinear protrusion disposed along the top of the first aperture and configured to redirect a coin having a first minimum diameter and being directed by the first protrusion toward the first aperture down along the primary race in an on-edge orientation; and a second protrusion disposed along the same wall as the first aperture and between the inlet port and the first protrusion, and configured to direct a coin traveling down the primary race toward the first protrusion.

17. The apparatus of claim 16 wherein the first protrusion is configured to direct only such coins as possess a second minimum diameter, which is less than the first minimum diameter, through the first aperture; and wherein the apparatus further comprises a downwardly inclined, tertiary coin race positioned within the body with generally vertical walls laterally spaced to enable coins to move down the tertiary race in a generally vertical, on-edge manner, said tertiary coin race being positioned in a plane laterally adjacent the primary race and on the opposite side of the primary race from the secondary race; and a second aperture positioned in the body between the primary race and an upper portion of the tertiary race, and proximate the first protrusion so as to pass coins, smaller in diameter than said second minimum diameter, from the primary race into the tertiary race.

18. The apparatus of claim 16 which further comprises:

a first additional coin race positioned within the body on the opposite side of the primary race from the secondary race; and a first additional aperture positioned in the body between the primary race and the first additional coin race, and between the inlet port and the first protrusion so as to pass coins from the primary race into the first additional race; and a magnet positioned in the body alongside the first race so as to direct magnetically attractable coins through the first additional aperture.

19. Apparatus for separating coins having different diameters comprising:

(a) a body having an inlet portal in an upper portion thereof capable of accepting coins of different diameters including a smallest diameter and a largest diameter;

(b) a downwardly inclined, walled, primary coin race disposed in the body, said primary coin race adapted to receive said coins from the portal and having a first pair of walls vertically disposed and laterally spaced to retain the coins in a generally on-edge disposition;

(c) a downwardly inclined, walled, secondary coin race disposed in the body in side-by-side and generally parallel relation to the primary race, and having a second pair of walls vertically disposed and laterally spaced to retain coins in a generally on-edge disposition, a first said wall of the secondary race being common with a first said wall of the primary coin race and commonly defining a first aperture adapted to receive coins from said primary race into said secondary race;

(d) a first protrusion extending from the second wall of the primary race into the primary race and configured to deflect coins having a first minimum diameter, including said largest diameter, from the primary race in an on-edge disposition toward said first aperture for reception by said first aperture, and to pass under said first protrusion any coins smaller than said first minimum diameter further down the primary race in an on-edge disposition; and (e) a second of the first wall of the primary race shaped to re-deflect coins deflected by said first protrusion which have a second minimum diameter, including the largest diameter coin, further down the primary race in an on-edge disposition and pass remaining coins deflected by said first protrusion in an on-edge disposition through said first aperture into said secondary race.

20. A method of separating various diameter size coins, which comprises the steps of:

passing the coins sequentially down a walled, downwardly inclined, primary coin race;

deflecting from a first wall of the primary coin race at least one of the sizes of coins across the primary race toward a first aperture in the second wall of the primary race;

passing at least some of the deflected coins smaller than the largest diameter coins through said first aperture, while re-deflecting said deflected coins of diameter larger than the coins passed through said first aperture, including the largest diameter coins, down the primary race; and maintaining all of the coins throughout all of the steps in a generally on-edge orientation.

21. A method of separating various diameter size coins which comprises:

passing the coins sequentially down a walled, downwardly inclined, primary coin race;

deflecting from a first wall of the primary coin race at least one of the sizes of coins across the primary race toward a first aperture in the second wall of the primary race;

passing at least some of the deflected coins smaller than the largest diameter coins through said first aperture, while re-deflecting said deflected coins of diameter larger than the coins passed through said first aperture down the primary coin race; and maintaining all of the coins throughout all of the steps in a generally on-edge orientation.

22. Apparatus for separating coins having different diameters, comprising:

a body having an inlet portal in an upper portion thereof capable of accepting coins of different diameters;

a downwardly inclined walled primary coin race disposed in the body, said primary coin race adapted to receive said coins from the portal and having a first pair of walls laterally spaced to retain coins in a generally on-edge orientation;

a downwardly inclined, walled, secondary coin race disposed in the body, said secondary coin race adjoining and generally parallel to the primary race and having a second pair of walls laterally spaced to retain coins in a generally on-edge orientation, a first said wall of the secondary race being common with a first said wall of the primary coin race and defining a first aperture adapted to receive coins having a maximum diameter less than said largest diameter;

a first protrusion extending from the second wall of the primary coin race into the primary coin race adapted to direct coins of at least one said diameter, including said largest diameter, across the primary race toward said first aperture for reception by said first aperture;

a second protrusion extending from said first wall of the primary coin race into the primary coin race and downward from the top of the primary coin race to re-deflect at least some of the reflected coins, including the largest diameter coins, further down the primary coin race but to enable reflected coins smaller than the re-deflected coins to be received by said first aperture for passage into said secondary coin race.

* * * * *